US012398489B2

(12) United States Patent
Taylor et al.

(10) Patent No.: US 12,398,489 B2
(45) **Date of Patent: *Aug. 26, 2025**

(54) THERMALLY AND DIMENSIONALLY STABILIZED ELECTROSPUN COMPOSITIONS AND METHODS OF MAKING SAME

(71) Applicant: Poly-Med, Inc., Anderson, SC (US)

(72) Inventors: Michael Scott Taylor, Anderson, SC (US); Seth Dylan McCullen, Greenville, SC (US)

(73) Assignee: Poly-Med, Inc., Anderson, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/401,925

(22) Filed: Jan. 2, 2024

(65) Prior Publication Data

US 2024/0287710 A1 Aug. 29, 2024

Related U.S. Application Data

(63) Continuation of application No. 17/976,140, filed on Oct. 28, 2022, which is a continuation of application (Continued)

(51) Int. Cl.
*D01F 6/84* (2006.01)
*D01D 1/02* (2006.01)

(Continued)

(52) U.S. Cl.
CPC ..... *D01F 6/84* (2013.01); *D01D 1/02* (2013.01); *D01D 5/003* (2013.01); *D01F 6/625* (2013.01);

(Continued)

(58) Field of Classification Search
None
See application file for complete search history.

(56) References Cited

U.S. PATENT DOCUMENTS 4,646,741 A 3/1987 Smith
7,172,765 B2 2/2007 Chu et al.

(Continued)

FOREIGN PATENT DOCUMENTS

EP 0707044 B1 3/2000
JP 2004-321484 A 11/2004

(Continued)

OTHER PUBLICATIONS

Extended European Search Report issued Jul. 21, 2017 in EP Application 15743098.4.

(Continued)

*Primary Examiner* — Lynda Salvatore
(74) *Attorney, Agent, or Firm* — Meunier Carlin & Curfman LLC

(57) ABSTRACT

Thermally stable absorbable fiber populations, i.e. fiber populations that do not undergo thermally induced crystallization, can be intermixed with thermally unstable fibers to yield a stabilizing effect without altering morphological properties of a fiber system. Via this, one may minimize thermally induced shrinkage and maintain physical properties of electrospun materials in the as-formed state.

11 Claims, 23 Drawing Sheets

Related U.S. Application Data

No. 16/823,674, filed on Mar. 19, 2020, now Pat. No. 11,486,058, which is a continuation of application No. 14/610,130, filed on Jan. 30, 2015, now Pat. No. 11,891,727.

(60) Provisional application No. 61/933,596, filed on Jan. 30, 2014.

(51) Int. Cl.

| | |
|---|---|
| ***D01D 5/00*** | (2006.01) |
| ***D01F 6/62*** | (2006.01) |
| ***D04H 1/435*** | (2012.01) |
| ***D04H 1/728*** | (2012.01) |

(52) U.S. Cl.

CPC ..... *D04H 1/435* (2013.01); *D04H 1/728* (2013.01); *D10B 2331/041* (2013.01); *D10B 2331/06* (2013.01); *D10B 2509/00* (2013.01); *Y10T 428/249921* (2015.04)

(56) References Cited

U.S. PATENT DOCUMENTS

| | | | | |
|---|---|---|---|---|
| 8,048,446 | B2 | 11/2011 | Lelkes et al. | |
| 8,128,954 | B2 | 3/2012 | Davis et al. | |
| 9,011,439 | B2 | 4/2015 | Shalaby | |
| 9,492,593 | B2 | 11/2016 | Shalaby | |
| 10,004,833 | B2 | 6/2018 | Shalaby | |
| 10,751,449 | B2 | 8/2020 | Shalaby | |
| 11,197,950 | B2 | 12/2021 | Shalaby | |
| 11,486,058 | B2 * | 11/2022 | Taylor | D01F 6/625 |
| 11,891,727 | B2 * | 2/2024 | Taylor | D01F 6/625 |
| 2002/0173213 | A1 | 11/2002 | Chu et al. | |
| 2003/0168756 | A1 | 9/2003 | Balkus et al. | |
| 2003/0228350 | A1 | 12/2003 | Chu et al. | |
| 2005/0070930 | A1 | 3/2005 | Kammerer | |
| 2005/0149158 | A1 | 7/2005 | Hunter et al. | |
| 2006/0085063 | A1 | 4/2006 | Shastri et al. | |
| 2006/0240063 | A9 | 10/2006 | Hunter et al. | |
| 2006/0263417 | A1 | 11/2006 | Lelkes et al. | |
| 2006/0264140 | A1 | 11/2006 | Andrady et al. | |
| 2008/0095748 | A1 | 4/2008 | Kharazi et al. | |
| 2008/0208323 | A1 | 8/2008 | El-Kurdi et al. | |
| 2008/0220054 | A1 | 9/2008 | Shastri et al. | |
| 2010/0143652 | A1 | 6/2010 | Stockton et al. | |
| 2010/0166854 | A1 | 7/2010 | Michniak-Kohn et al. | |
| 2010/0261799 | A1 | 10/2010 | Vachon et al. | |
| 2010/0274283 | A1 | 10/2010 | Kirsch et al. | |
| 2011/0143429 | A1 | 6/2011 | Chun et al. | |
| 2012/0068384 | A1 | 3/2012 | Phaneuf et al. | |
| 2012/0071566 | A1 | 3/2012 | Kelly et al. | |
| 2012/0088424 | A1 | 4/2012 | Eric et al. | |
| 2012/0315225 | A1 | 12/2012 | Porbeni et al. | |
| 2013/0253663 | A1 | 9/2013 | Amoroso et al. | |
| 2013/0267137 | A1 | 10/2013 | Peniston et al. | |
| 2013/0267972 | A1 | 10/2013 | Peniston et al. | |
| 2014/0141152 | A1 | 5/2014 | Sostek et al. | |
| 2014/0271795 | A1 | 9/2014 | Phaneuf et al. | |
| 2015/0211151 | A1 | 7/2015 | Taylor et al. | |
| 2019/0330768 | A1 * | 10/2019 | Taylor | D01D 1/02 |
| 2020/0216983 | A1 | 7/2020 | Taylor et al. | |
| 2023/0250560 | A1 * | 8/2023 | Taylor | D01F 6/84 428/221 |

FOREIGN PATENT DOCUMENTS

| | | | |
|---|---|---|---|
| WO | 2006116000 | A2 | 11/2006 |
| WO | 2010143646 | A1 | 12/2010 |
| WO | 2015116917 | A1 | 8/2015 |

OTHER PUBLICATIONS

Extended European Search Report issued Mar. 12, 2020 in EP Application 19205535.8.

International Search Report and Written Opinion mailed Apr. 22, 2015 in international application PCT/US2015/013732.

International Search Report and Written opinion mailed Jun. 16, 2015 in international application PCT/US2015/013723.

Sell et al., "Extracellular matrix regenerated: tissue engineering via electrospun biomimetic nanofibers," Polymer International vol. 56, pp. 1349-1360.

Sigma-Aldrich, Chemical Structures.

Thompson and Woods. The transitions of Polyethylene Terephthalate, Transactions of the Faraday Society, 1956, 15 pages.

Office Action issued for U.S. Appl. No. 17/976,140, dated Jun. 23, 2023.

Office Action issued for U.S. Appl. No. 17/976,140, dated Feb. 29, 2024.

* cited by examiner

Table A

DATA SET A

Percent Retention of Initial Tensile Strength vs. Time (days)

| | Day 0 | Day 3 | Day 5 | Day 7 |
|---|---|---|---|---|
| **PGLA** | | | | |
| Sample 1 | 8 | 7.5 | 8.5 | 5.9 |
| Sample 2 | 9.1 | 7.7 | 5.1 | 6 |
| Sample 3 | 7.2 | 7.7 | 7.1 | 7.4 |
| Average | 8.1 | 7.633333 | 6.9 | 6.9 |
| Standard Deviation | 0.953939 | 0.11547 | 1.708801 | 1.708801 |
| Percent | 100% | 94% | 85% | 85% |
| Standard Deviation | 12% | 1% | 21% | 21% |

| | Day 0 | Day 3 | Day 5 | Day 7 |
|---|---|---|---|---|
| **PDO** | | | | |
| Sample 1 | 7.8 | 7.9 | 5.1 | 4.6 |
| Sample 2 | 7.2 | 7.6 | 3.3 | 4.4 |
| Sample 3 | 7 | 7.6 | 4.2 | 4.5 |
| Average | 7.333333 | 7.7 | 4.2 | 4.5 |
| Standard Deviation | 0.416333 | 0.173205 | 0.9 | 0.1 |
| Percent | 100% | 105% | 57% | 61% |
| Standard Deviation | 6% | 2% | 12% | 1% |

| | Day 0 | Day 3 | Day 5 | Day 7 |
|---|---|---|---|---|
| **PGLA/PDO** | | | | |
| Sample 1 | 6 | 6.3 | 5.2 | 4.2 |
| Sample 2 | 4.7 | 5.2 | 3.8 | 5.6 |
| Sample 3 | 5.8 | 5.8 | 3.2 | 2 |
| Average | 5.5 | 5.766667 | 4.06667 | 3.933333 |
| Standard Deviation | 0.7 | 0.550757 | 1.02632 | 1.814754 |
| Percent | 100% | 105% | 74% | 72% |
| Standard Deviation | 13% | 10% | 19% | 33% |

FIG. 14

Table B

DATA SET B

| Elongation at Break (%) | Day 0 | Day 3 | Day 5 | Day 7 |
|---|---|---|---|---|
| **PGLA** | | | | |
| Sample 1 | 307 | 48.7 | 28.5 | 12.3 |
| Sample 2 | 334 | 42.7 | 42.8 | 15.9 |
| Sample 3 | 294 | 38.6 | 33.3 | 19.1 |
| Average | 311.6667 | 43.3333 | 34.8667 | 15.7667 |
| Standard Deviation | 20.40425 | 5.079698 | 7.277591 | 3.40196 |
| Percent | 100% | 14% | 11% | 5% |
| Standard Deviation | 7% | 2% | 2% | 1% |

| Elongation at Break (%) | Day 0 | Day 3 | Day 5 | Day 7 |
|---|---|---|---|---|
| **PDO** | | | | |
| Sample 1 | 349 | 286 | 204 | 180.8 |
| Sample 2 | 319 | 306 | 148 | 159.4 |
| Sample 3 | 311 | 250 | 151 | 184.7 |
| Average | 326.3333 | 280.6667 | 167.6667 | 174.9667 |
| Standard Deviation | 20.03331 | 28.3784 | 31.50132 | 13.62143 |
| Percent | 100% | 86% | 51% | 54% |
| Standard Deviation | 6% | 9% | 10% | 4% |

| Elongation at Break (%) | Day 0 | Day 3 | Day 5 | Day 7 |
|---|---|---|---|---|
| **PGLA/PDO** | | | | |
| Sample 1 | 300 | 129 | 66.4 | 43.1 |
| Sample 2 | 269 | 111 | 85 | 73.7 |
| Sample 3 | 293 | 108.4 | 48.4 | 30.8 |
| Average | 287.3333 | 116.1333 | 66.6 | 49.2 |
| Standard Deviation | 16.25833 | 11.21844 | 18.30082 | 22.09095 |
| Percent | 100% | 40% | 23% | 17% |
| Standard Deviation | 6% | 4% | 6% | 8% |

FIG. 16

Table D

DATA SET D

| Suture Pull-Out Strength vs. Time | Day 0 | Day 3 | Day 5 | Day 7 |
|---|---|---|---|---|
| **PGLA** | | | | |
| Sample 1 | 4.9 | 3.23 | 1.07 | 0.47 |
| Sample 2 | 3.73 | 1.36 | 1.47 | 0.5 |
| Sample 3 | 3.8 | 1.98 | 1.76 | 1 |
| Average | 4.143333 | 2.19 | 1.433333 | 0.656667 |
| Standard Deviation | 0.656227 | 0.952523 | 0.346458 | 0.297714 |
| Percent | 100% | 53% | 35% | 16% |
| Standard Deviation | 16% | 23% | 8% | 7% |

| Suture Pull-Out Strength vs. Time | Day 0 | Day 3 | Day 5 | Day 7 |
|---|---|---|---|---|
| **PDO** | | | | |
| Sample 1 | 2.99 | 3.03 | 3.1 | 3.39 |
| Sample 2 | 2.79 | 2.9 | 2.84 | 2.65 |
| Sample 3 | | 2.99 | 2.98 | 2.58 |
| Average | 2.89 | 2.973333 | 2.973333 | 2.873333 |
| Standard Deviation | 0.141421 | 0.066583 | 0.130128 | 0.448813 |
| Percent | 100% | 100% | 95% | 99% |
| Standard Deviation | 5% | 2% | 5% | 16% |

| Suture Pull-Out Strength vs. Time | Day 0 | Day 3 | Day 5 | Day 7 |
|---|---|---|---|---|
| **PGLA/PDO** | | | | |
| Sample 1 | 1.91 | 1.98 | 1.21 | 1.5 |
| Sample 2 | 2.72 | 1.86 | 1.2 | 1 |
| Sample 3 | 2.73 | 2.01 | 0.9 | 0.77 |
| Average | 2.453333 | 1.95 | 1.103333 | 1.09 |
| Standard Deviation | 0.470567 | 0.079373 | 0.176163 | 0.373229 |
| Percent | 100% | 80% | 45% | 44% |
| Standard Deviation | 19% | 3% | 7% | 15% |

FIG. 19

DATA SET E

Properties of PGLA Electrospun Fabrics Containing Different Amounts of PPD

| Free Shrinkage at 50°C | | | | | |
|---|---|---|---|---|---|
| | 0% PPD | 33% PPD | 50% PPD | 66% PPD | 100% PPD |
| Sample 1 | 0.8 | 0.96 | 0.97 | 1 | 1 |
| Sample 2 | 0.85 | 0.936 | 1 | 1 | 1 |
| Sample 3 | 0.70 | 0.9021 | 0.99 | 1 | 1 |
| Average | 21.67% | 6.73% | 1.33% | 0.00% | 0.00% |
| Standard Deviation | 7.64% | 2.91% | 1.53% | 0.00% | 0.00% |

| Ultimate Tensile Load (N) | | | | | |
|---|---|---|---|---|---|
| | 0% PPD | 33% PPD | 50% PPD | 66% PPD | 100% PPD |
| Sample 1 | 8.8 | 7.1 | 6.8 | 3.8 | 3.1 |
| Sample 2 | 8.7 | 5.9 | 6 | 3.8 | 3.8 |
| Sample 3 | 8.5 | 6.4 | 7.7 | 5.1 | 3.8 |
| Average | 8.666666667 | 6.466666667 | 6.833333333 | 4.233333333 | 3.566666667 |
| Standard Deviation | 0.152752523 | 0.602771377 | 0.850490055 | 0.75055535 | 0.404145188 |

| Percent Elongation at Break | | | | | |
|---|---|---|---|---|---|
| | 0% PPD | 33% PPD | 50% PPD | 66% PPD | 100% PPD |
| Sample 1 | 403.3 | 438.7 | 304.2 | 276.3 | 194.5 |
| Sample 2 | 438.7 | 359.4 | 292.2 | 272.3 | 242.2 |
| Sample 3 | 396.8 | 437.4 | 294.2 | 350.4 | 237 |
| Average | 412.9333333 | 411.8333333 | 293.8666667 | 299.6666667 | 224.5666667 |
| Standard Deviation | 22.55001848 | 45.41325064 | 6.429100507 | 43.98185232 | 26.16798298 |

| Suture Pull-Out Force (N) | | | | | |
|---|---|---|---|---|---|
| | 0% PPD | 33% PPD | 50% PPD | 66% PPD | 100% PPD |
| Sample 1 | 2 | 1.2 | 0.8 | 0.8 | 0.6 |
| Sample 2 | 2.3 | 1.3 | 1.5 | 0.8 | 0.8 |
| Sample 3 | 2.2 | 1.5 | 0.9 | 0.6 | 0.5 |
| Average | 2.15 | 1.333333333 | 1.066666667 | 0.733333333 | 0.633333333 |
| Standard Deviation | 0.212132034 | 0.152752523 | 0.37859389 | 0.115470054 | 0.152752523 |

FIG. 20

THERMALLY AND DIMENSIONALLY STABILIZED ELECTROSPUN COMPOSITIONS AND METHODS OF MAKING SAME

BACKGROUND OF THE INVENTION

Synthetic absorbable polymers are routinely used as medical implants, scaffolds for tissue engineering and drug delivery devices. Since the emergence and acceptance of the absorbable suture VICRYL, available from Ethicon Inc., a subsidiary of Johnson and Johnson, significant work has been performed with absorbable polyesters due to their long industrial use history, well known degradation mechanism, non-toxic by-products, and availability in multiple FDA-approved medical devices.

Recently, the electrospinning method, using an electrical charge to draw very fine, typically on the micro or nano scale, fibers from a liquid, has generated significant interest in medical device applications as this process can produce micro-fibrous materials with a topography similar to the native extracellular matrix. Absorbable and non-absorbable electrospun materials are capable of mimicking the topography of the extracellular matrix due to their fibrous form, as well as providing an ideal substrate for biological interaction due to their enhanced surface area to volume ratio.

During the electrospinning process, a polymer is dissolved in solution and is metered at a controlled flow rate through a capillary or orifice. By applying a critical voltage to overcome the surface tension of the polymer solution (and with sufficient molecular chain entanglement in solution) fiber formation can occur. Application of a critical voltage induces a high charge density forming a Taylor cone, the cone observed in electrospinning, electrospraying and hydrodynamic spray processes from which a jet of charged material emanates above a threshold voltage, at the tip of the orifice.

Emerging from the Taylor cone, a rapid whipping instability, or fiber jet, is formed moving at approximately 10 m/s from the orifice to a distanced collector or substrate. Due to the high velocity of the fiber jet, fiber formation occurs on the order of milliseconds due to the rapid evaporation of the solvent, inhibiting polymer crystallization. Typically, the ejected jets from the polymer solution is elongated more than 10,000 draw ratio in a time period of 0.05 seconds. This high elongation ratio is driven by the electric force induced whipping instability, and the polymer chains may remain in an elongated state after fiber solidification due to this high elongation and chain confinement within micron-sized fibers.

For semi-crystalline polymers, retarded crystallization is usually observed since fast solidification of the stretched polymer chains does not allow time to organize into suitable crystal regions, and is also inhibited by small fiber diameters. The formation process can also impart a significant amount of internal stresses into the resulting fibers. As a result of the highly elongated polymer chains within the fibers in an amorphous form, these materials can undergo both morphological and mechanical property changes when exposed to heat due to cold crystallization as well as stress relief via application of heat.

Electrospun materials are advantageous for a range of applications in the medical device field for tissue replacement, augmentation, drug delivery, among other applications. However, electrospun materials may be relatively unstable and may undergo crystallization due to their amorphous nature and highly elongated polymer chains residing within their polymeric fibers. Further, residual stresses are generated from the dynamic "whipping" process used to produce small-diameter fibers. As typical electrospun materials undergo thermal treatments/exposure, polymer crystallization can occur, distorting fiber topography, pore size, inducing shrinkage and altering mechanical properties. For instance, in the case of poly(lactic-co-glycolic) acid ("PGLA") copolymers, such as VICRYL 90/10 PGLA, at temperatures of 37° C., shrinkage as high as 20% has been observed. This results in smaller constructs with significantly higher stiffness as well as loss of desirable chemical and mechanical properties.

What is needed in the art are improved electrospun materials that exhibit both structural and thermal stability without requiring additional processing or treatment once the fiber web or mesh is formed. The following disclosure addresses this need.

SUMMARY OF THE INVENTION

Electrospun materials are of great interest for medical applications, but are limited based on their instability. What is needed are thermally stable absorbable or non-absorbable electrospun materials with little or limited macroscopic changes in physical and mechanical properties when exposed to thermal, mechanical, or other stresses. As the present disclosure explains, this may be realized through employing at least two independent fiber populations with a major fiber component comprising at least one thermally unstable species and a minor fiber component comprising at least one thermally stable species which are co-mingled and distributed throughout. Further, the disclosed electrospun materials would not rely on downstream chemical processing or complex layered or fiber blend approaches, as known in the art, and would be superior to current technologies that employ layered constructs, cross-linked constructs, and/or creating nonwoven constructs with a core/sheath or blended fiber. Current technologies create increased production complexity due to the need for specialized equipment and cross-linking requires additional processing, such as exposure to ultraviolet light, and the introduction of additional chemical compounds that could be detrimental to product biocompatibility. The current disclosures rectifies these shortcomings.

In one embodiment, a thermally stable electrospun material may be provided and may include at least two independent fiber populations: a major fiber component comprising at least one thermally unstable species and a minor fiber component comprising at least one thermally stable species. The major and minor fiber components may be co-mingled and distributed throughout the structure of the electrospun material. Further, the material may exhibit limited macroscopic changes in physical and mechanical properties when exposed to thermal or mechanical stress.

In further embodiments, the thermally stable species may comprise a bioabsorbable polyether-ester that may be a bioabsorbable polyether-ester comprises poly(para-dioxanone). In yet another embodiment, this thermally stable species may comprise at least 30 percent of the thermally stable electrospun material. In a still further embodiment, the thermally unstable species may comprise a bioabsorbable polyester, which may be a copolymer of glycolide and lactide. Still further, the copolymer of glycolide and lactide may have a monomer ratio of glycolide from 80 to 95 and lactide from 20 to 5.

In another embodiment, a multiple fiber population electrospun fabric may include at least two fiber populations wherein at least one fiber population is a thermally stable polyether-ester and at least one fiber population is a thermally unstable bioabsorbable polyester. The at least two fiber populations may be dispersed throughout the three-dimensional structure of the multiple fiber electrospun fabric and may mimic the fibrous topography of the extracellular matrix.

In a further embodiment, the thermally stable polyether-ester may comprise at least 30 percent of the thermally stable electrospun material. Even further, the thermally stable polyether-ester may comprise poly(para-dioxanone). In another embodiment, the thermally unstable bioabsorbable polyester may comprises a poly(L-lactide-co-glycolide) copolymer. In a still further embodiment, the thermally stable polyether-ester comprises at least 33 percent of the multiple fiber population electrospun fabric. In yet another embodiment, pore size of the multiple fiber population electrospun fabric may be maintained after exposure of temperatures of up to 50° C.

In a still yet further embodiment, a method of forming a fiber mesh may be provided wherein a bioabsorbable polyester and a polyether-ester may be dissolved in a solvent. The resulting solutions may then be dispensed in an intermixed fashion onto a substrate to form a fiber mesh. A fiber mesh may be formed with a three-dimensional structure wherein the bioabsorbable polyester and polyether-ester are dispersed throughout the three-dimensional structure of the fiber mesh.

In another embodiment, the bioabsorbable polyester may comprise a poly(L-lactide-co-glycolide) copolymer, which may comprise poly(para-dioxanone). Yet further, the bioabsorbable polyester and polyether ester solutions may be dispersed in such a fashion wherein the polyether ester comprises at least 30% of the fiber mesh. Still further, the polyether ester may comprise at least 33% of the fiber mesh.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 14 is Data Set A and its associated data.

FIG. 16 is Data Set B and its associated data.

FIG. 19 is Data Set D and its associated data.

FIG. 20 is Data Set E and its associated data.

Figure 1:
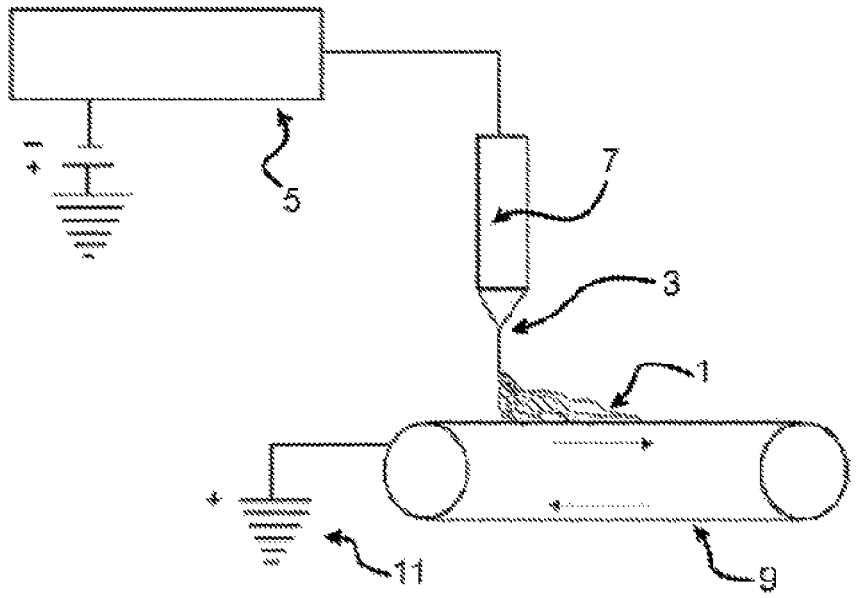
FIG. 1 is a schematic view of an electrospinning process.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

The current disclosure provides electrospun materials featuring a significant reduction in shrinkage while maintaining desirable characteristics such as handling properties, mechanics, and morphology. This may be achieved by utilizing a minor polymer component providing a stabilizing effect in conjunction with a major polymer component. The stabilizing effect is unexpected due to the minor component, such as "stabilizing" fibers, providing long range stability, such as overall fabric dimensions, as well as short range stability via individual unstable fiber elements that are not necessarily bound by the other stabilizing fibers.

The current disclosure differs from prior art concepts to improve dimensional and thermal stability for electrospun materials, which include (1) layered fabrics, (2) cross-linking, and (3) composite fibers wherein the individual fiber comprises nonstable and stabilizing elements. Fibers of the current disclosure may range in diameter from 0.1 to 10 μM, more preferably from 0.25 to 5 μM, even more preferably from 0.4 to 1.6 μM. In an ever further preferred embodiment, the fiber diameter may be less than or equal to 1.75 μM. Also, it has been discovered that there is a direct correlation between porosity and fiber diameter: the larger the fiber diameter, the larger the pore size, and the smaller the diameter, the smaller the pore size.

Furthermore, the pore size may be controlled by the method used in fabrication. For example, cryogenic spinning may produce highly porous fabrics that are more porous than traditional electrospinning performed at room temperature using a collecting drum also at room temperature. In one instance, with respect to cryogenic spinning, the collector needs to be chilled below the freezing (melting point) of water. The larger the temperature gradient the higher likelihood for ice accumulation. The humidity also needs to be greater than 30% in order to have adequate ambient moisture of water for ice formation. For example, if a collecting drum is cooled with dry ice to approximately −80° C., then ice crystal formation will occur as fibers are deposited on the collector during electrospinning. The chilled collector will then have a deposited mat with ice crystals embedded in the fibers. In a still further embodiment, a second layer of fibers may be deposited onto the surface of the first fibrous layer, and then the two layer fabric can be lyophilized, as known to those of skill in the art, to vaporize the ice crystals. In one instance, lyophilization may be used following electrospinning. The fabric may be removed from the collector and placed under vacuum (51.5 Torr) with a cold source less than the melting temperature of the solvent used (i.e. for water the cold source needs to be at or less than 0° C.). This may result in a construct with two layers of very different properties. The bottom layer (initially deposited onto the collector) provides mechanical strength and the second outer layer may provide a very porous infrastructure that can allow for cellular ingrowth. These properties are the result of different porosities within the two layers: small pores of approximately 10 $\mu m^2$ are observed in the first layer whereas larger pores on the order of 100-2500 $\mu m^2$ (and possibly ranging from hundreds to thousands of $\mu m^2$) may be observed in the outer layer as a result of the lyophilization procedure. Furthermore, both of the layers may be thermally stable as a thermally stable polymer may be co-spun with a thermally unstable polymer. Since many of the proposed uses of electrospun fabrics rely on the high compliance of the constructs and the use as a seal or barrier, structural integrity is of great importance.

Thus, the current disclosure provides a system that may exhibit modularity in strength, modulus and porosity. Additionally, the current disclosure may be formed into various geometries including core-shell arrangements, islands-in-the-sea configuration, pie-like configurations, as well as variations of fiber placement throughout the cross section of the structures disclosed herein. This disclosure also may function as a carrier for biologically active agents such as various drugs, while providing a dimensionally and thermally stabilized construct, especially under the required conditions including the biologically-relevant 37° C., as well as 50° C. which is needed for shelf stability and sterilization processing.

Indeed, the current disclosure may be use to form layered, core/sheath, blended, and/or composite fibers. Composite fibers may include fibers blended from two separate polymeric systems that are heterogeneously or homogenously blended. One benefit of employing these constructs would be tissue ingrowth due to the presence of degradable laminates adjacent to intermixed population of bulk material. Even further, articulated surfaces may be produced wherein an aligned fiber surface is formed in contrast to a randomly aligned surface. However, randomly aligned fibers, as opposed to aligned fibers, may be used to form an adhesion surface.

In a preferred embodiment, fiber distortion of an amorphous crystallizable component of a polymer is inhibited when the polymer is exposed to heat. Thermally stable absorbable fiber populations, i.e. fiber populations that do not significantly experience dimensional changes in the temperature ranges typical for sterilization, storage, or application, can be intermixed to yield a stabilizing effect without altering morphological properties of the first fiber system. Dimensional changes (e.g. shrinkage) can be the result of stress relief upon exposure to heat or due to crystallization; stabilization can prevent or reduce the dimensional changes as a result of either stress relief or crystallization, or a combination of both. Accordingly, by addition of a stabilizing fiber population one may minimize thermally induced shrinkage and maintain physical properties of electrospun materials in the as-formed state.

In a further embodiment, at least two independent fiber populations, one the major component and one the minor component, are formed from separate spinning solutions. They are used to form a mesh or web comprised of electrospun materials in a single process step without requiring further chemical or mechanical processing to impart thermal, dimensional, and mechanical stability, such as treatment by ultraviolet light or other means, introduction of crosslinking or stabilizing materials, or layering the web to improve structural integrity.

The success of the current disclosure is unexpected because the minor component would change the thermal, dimensional, and mechanical stability of the major component when the two are combined in an electrospun web. Thermally stable absorbable fiber populations, i.e. fiber populations that do not significantly experience thermally induced dimensional changes (e.g. size reduction), can be intermixed to yield a stabilizing effect without altering morphological properties of the first fiber system. By addition of a stabilizing fiber population one may minimize thermally induced shrinkage and maintain physical properties of electrospun materials in the as-formed state.

The stabilizing fiber population restrains the second fiber population from undergoing macroscopic changes while still allowing crystallization to occur on the molecular level within one or both fiber populations. As the intermixed fiber populated samples are exposed to thermal treatments approaching and above the glass transition temperature (Tg) of the unstable fiber population, the oriented, yet un-crystallized polymer chains, begin to undergo molecular motion allowing for the formation of crystallites. This mechanism may induce the fibers to undergo morphological changes, specifically fiber contraction due to molecular reorientation. Due to the presence of the stabilizing fiber population, the unstable fiber population is entrapped and cannot undergo restructuring that is characteristic of thermal shrinkage and dimensional changes. Though the unstabilized fiber population retains the same morphology, it is able to undergo partial or full crystallization imparted by the application of heat above its Tg. This can be evidenced by performing a differential scanning calorimetry measurement and determining the change in the enthalpy of the sample. Transition from an amorphous solid to crystalline solid is an exothermic process, and results in a peak in the DSC signal. As the temperature increases the electrospun material eventually reaches its melting temperature (Tm) resulting in an endothermic peak in the DSC curve. Materials exposed to thermal treatments that are crystallizable, and then undergo crystallization upon exposure to the thermal treatment, will show a reduction in their crystallization peak.

In one embodiment, the present disclosure may be a nonwoven fabric or mesh. Nonwoven fabrics or meshes are based on a fibrous web. The characteristics of the web determine the physical properties of the final product. These characteristics depend largely on the web geometry, which is determined by the mode of web formation. Web geometry includes the predominant fiber direction, whether oriented or random, fiber shape (straight, hooked or curled), the extent of inter-fiber engagement or entanglement, crimp and z-direction compaction as well as orientation. Web characteristics are also influenced by the fiber diameter, fiber welding, fiber length, fiber surface characteristics such as fiber porosity, pore size, web weight, chemical and mechanical properties of the polymer or polymers comprising the fiber. Various ways of forming the fibrous web include spun melt, spun bond, melt blowing, solution spinning (i.e., wet-spinning), centrifugal melt spinning, liquid shear spinning and electrospinning. In one embodiment, the fibrous web is formed by electrospinning.

FIG. 1 shows a schematic diagram of electrospinning. The process makes use of electrostatic and mechanical force to spin fibers 1 from the tip of a fine orifice or spinneret 3. Spinneret 3 is maintained at positive or negative charge by a power supply 5. When the electrostatic repelling force overcomes the surface tension force of the polymer solution 7, the polymeric solution 7 ejects out of spinneret 3 and forms an extremely fine continuous filament or fibers 1. These fibers 1 are collected onto a rotating or stationary collector 9 with an electrode 11 beneath the opposite charge, or possibly grounded, to that of the spinneret 3 where they accumulate and bond together to form nanofiber fabric, not shown. Multiple spinnerets providing independent, separate fiber populations may be employed. In a preferred embodiment, three spinnerets 3 may be employed. These spinnerets may each provide the same polymer, three different polymers, or one spinneret may contain a different polymer while the other two spinnerets contain the same polymer.

In one embodiment, the electrospinning apparatus includes at least one metering pump, a needle array comprised of at least two needles, at least one high voltage power supply, and a collector. The metering pump can be a syringe pump and dispenses the polymer solution at a controlled and well-defined flow rate to the needle array and can include virtually any pumping mechanism. The needle array encompasses at least two needles that dispense different polymer solutions with flow rates in the range of 0.1-100 ml/hr. The needle array is comprised of needles that can vary from any size (gauge) and in this example include needle sizes of 20 and 25 gauge but can include any orifice geometry or shape. The spacings between the needles can vary and may include spacings of at least 0.5 inches. The high voltage power supply provides sufficient voltage to overcome the surface tension of the polymer solution in this example can range from +10 to +45 kV.

The current disclosure may use various ways of combining two fiber populations comprised of a polymer, copolymer, or multiple polymers into an intermingled fiber whole. For instance, possible ways of commingling fibers include electrospinning of at least two distinct and independent fiber populations from separate spinnerets, which creates intermingled fibers, where the major non-stable fiber population is stabilized by the minor fiber population. For this disclosure, major fiber, major component, or major polymer connotes a fiber, component or polymer, whether a single polymer, multiple polymers, or copolymers, that are present by in an amount greater than 30%, 35%, 40%, 45%, 50%, 55%, or 60% by weight in the resulting web or mesh. Components of the resulting mesh can vary based on the amount of polymer deposited and can be controlled by the flow rate of the polymers being dispensed to form the mesh.

The distribution of the major and minor fibers may vary. The distribution may be uniform throughout the web, such as horizontally or vertically uniform or uniform throughout the thickness, length and width of the web. The distribution may also be random with the minor fiber distributed through a web of major fiber population in a random fashion. Further, the distribution may also be such that "patches" or localized regions of the minor fiber are located throughout the web such that groups of the minor fibers are located in some locations but absent in others forming laminates of the minor fiber population between the major fiber population or variations of the major and minor fiber population. In one particular embodiment, uniform random distribution throughout the thickness or depth of the resultant web. In a further embodiment, the ratio of major to minor component by weight may be 85/15, 80/20, 75/25, 70/30, 65/35, 60/40, 55/45, and 50/50 as well as values falling between the enumerated ratios. In a more preferred embodiment the major to minor component ration may be 67% to 33%.

The fibers of the current disclosure may comprise polymers such as polyesters, polyester-carbonates, polyethers, polyether-ester or copolymers of the above. In a further preferred embodiment, the major fiber is a bioabsorbable polymer such as a homopolymer or copolymer of polyglycolide (PGA) and copolymers, thereof, poly (glycolic-co-lactic) acid (PGLA) and poly(lactic-co-glycolic) (PLGA), poly(glycolide-co-TMC), poly(glycolide-co-caprolactone-co-TMC), polyglycolic acid (PGA) and copolymers thereof, a polyhydroxyalkanoate (PHA) such as: polyhydroxybutyrate (PHB); poly-4-hydroxybutyrate (P4HB); polyhydroxyvalerate (PHV); polyhydroxyhexanoate (PHH); polyhydroxyoctanoate (PHO) and their copolymers, and polycaprolactone (PCL) or combinations of the above. In a further preferred embodiment, the major fiber is a bioabsorbable polyester. Additionally, any polymer that is degradable by hydrolysis or other biodegradation mechanisms and contains the following monomeric units of trimethylene carbonate, lactide, glycolide, s-caprolactone, and para-dioxanone is applicable.

In a more preferred embodiment, the polymer is an absorbable copolymer of PGLA. In a further embodiment, the monomer ratio of glycolide to lactide in the PGLA used for the polymerization may be 95:5, 90:10, 85:15, 80:20, 75:25, 70:30, 65:35, 60:40, 55:45 or ratios between these amounts. In a preferred embodiment, the monomer ratio is 90:10. Polymerization of PGLA comprises combining the monomeric units L-lactide and glycolide at a mole ratio of 1:9 with an initiator decyl alcohol. These materials are heated to 110° C. until a homogenous mixture is formed at which point a catalyst is added at 0.05M (Tin (II) 2-ethyl hexanoate) at a final monomer to catalyst ratio of 80,000:1. The reaction is then heated to 220° C. and reacted for at least 3 hours.

The minor component may comprise thermally stable absorbable fiber populations. In one embodiment, the minor component may comprise polymers selected from polyesters, polyethers, polyether-ester or copolymers of the above. In a further embodiment, the minor component may comprise a bioabsorbable polyether-ester such as a para-dioxanone monomer (PDO) or poly(paradioxanone) polymer (PPD). Other minor components can include copolymers comprised of polymers where the majority of the polymer is comprised of PPD, poly(ε-caprolactone) and its copolymers, poly(L-lactic acid), amongst others. In a further embodiment, the amount of PPD may range from 10% to 80%. In a more preferred embodiment, the amount of PPD is approximately 33%.

Figure 2:
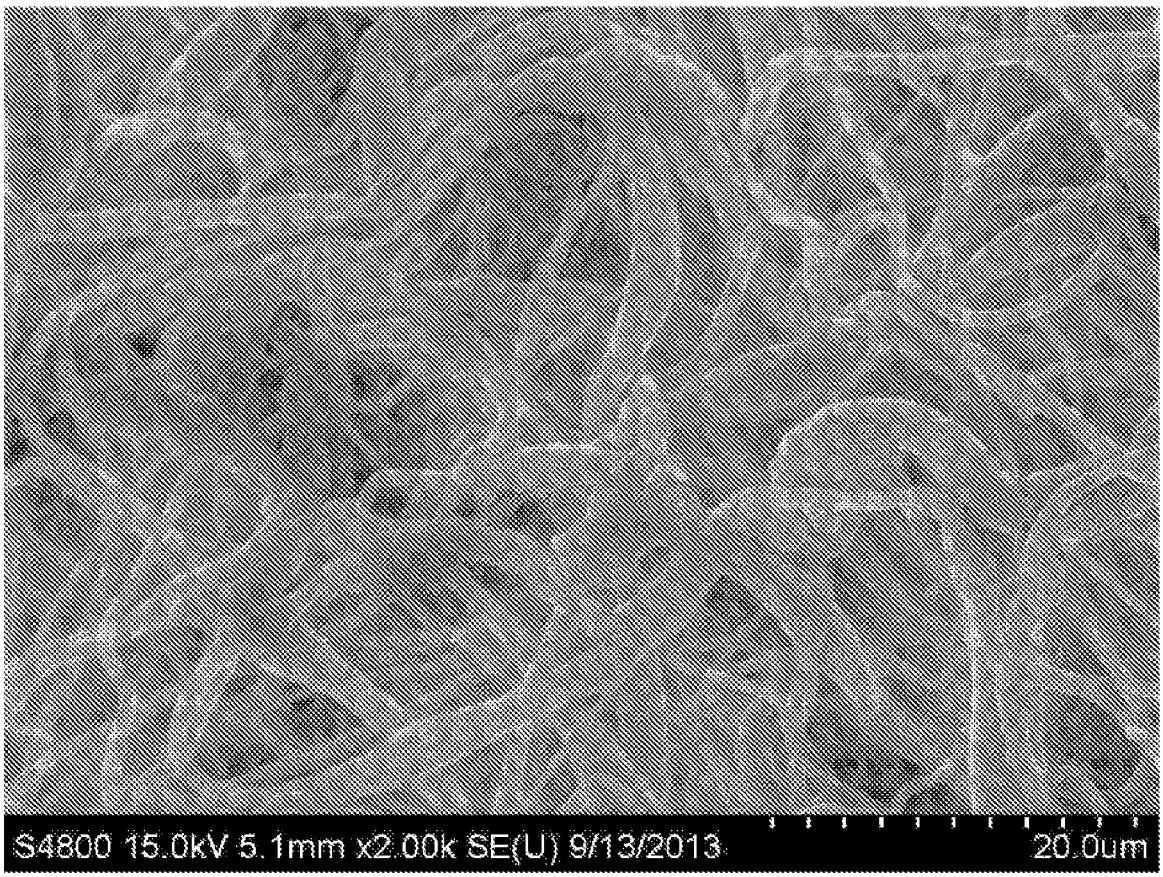
FIG. 2 shows an electron microscope view of 90/10 PGLA fibers after exposure to 45° C. for 30 minutes.

FIG. 2 shows typical 90/10 PGLA polymer fibers after exposure to 45° C. for 30 minutes. As FIG. 2 shows, the fibers exhibit structural deformities as well as clumping and gathering after thermal exposure.

Figure 3:
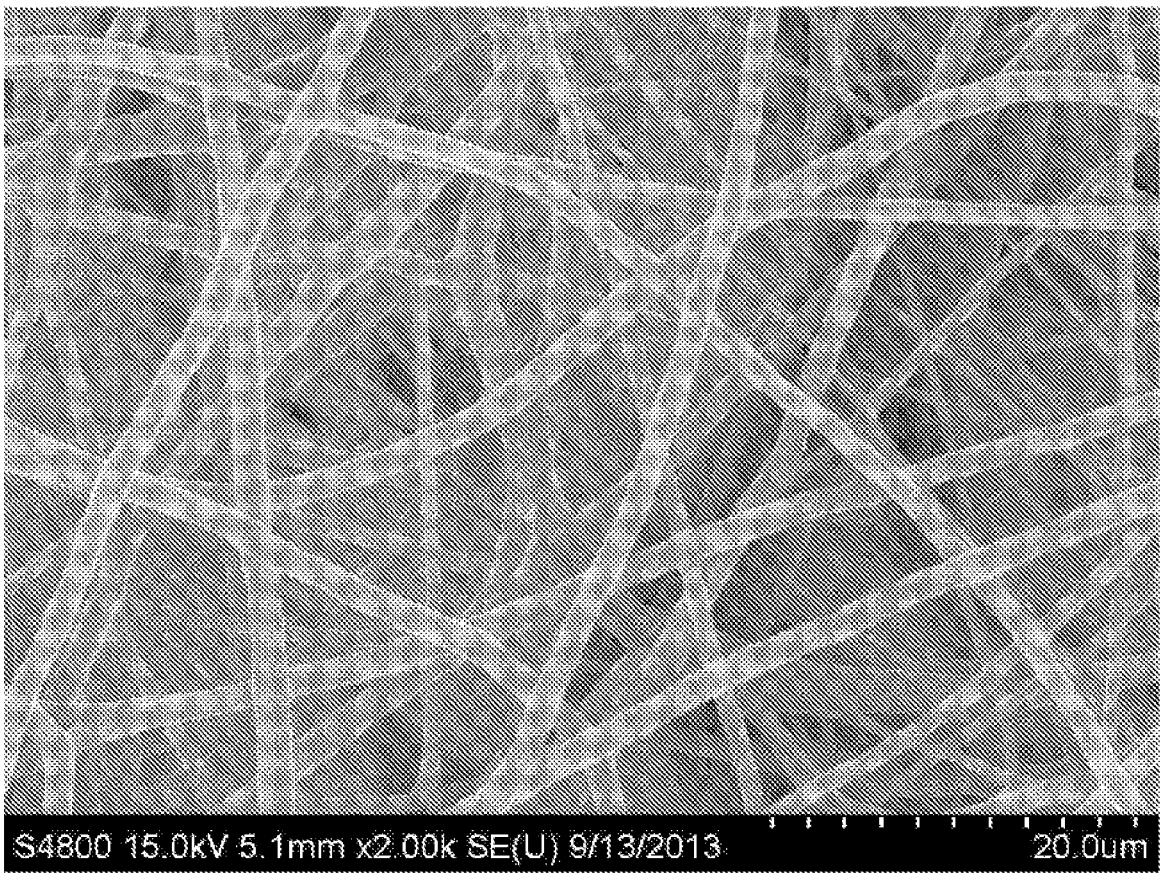
FIG. 3 shows an electron microscope view of 90/10 PGLA plus PPD Cospun fibers after exposure to 45° C. for 30 minutes.
Figure 4:
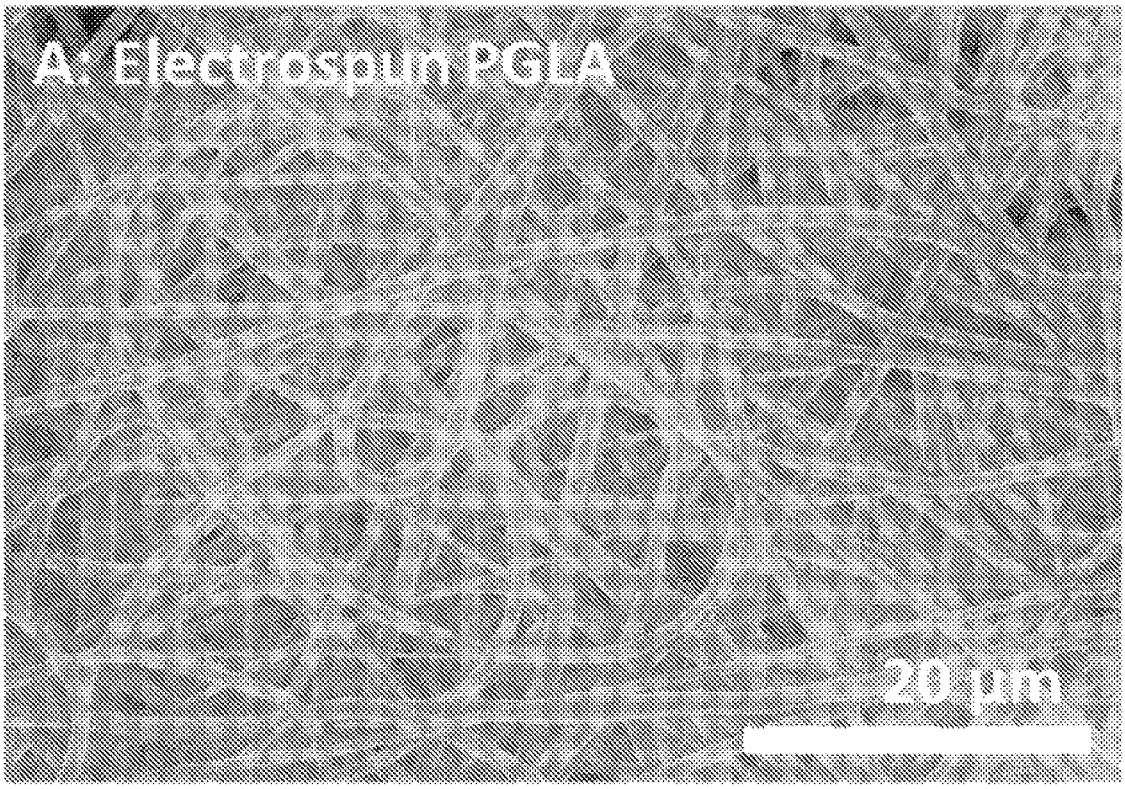
FIG. 4 shows an electron microscopy image of a PGLA fiber network without PPD.
Figure 5:
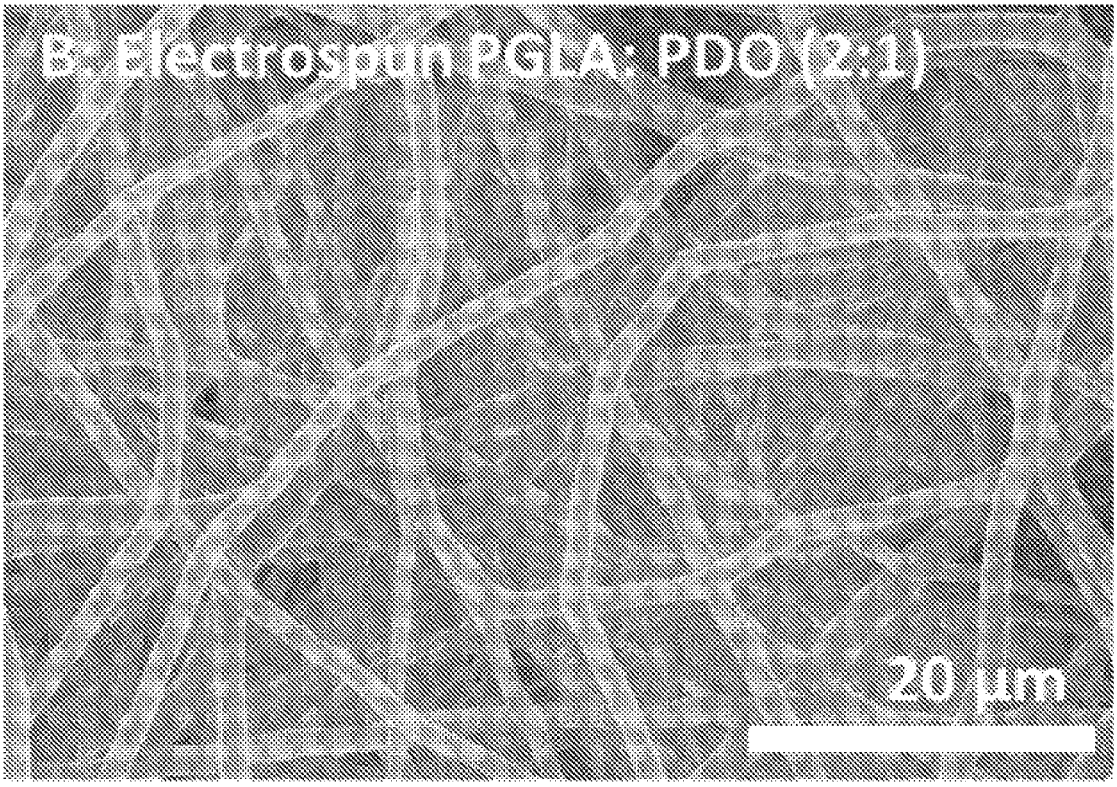
FIG. 5 shows an electron microscopy image of PGLA with PPD at a 2:1 ratio.
Figure 6:
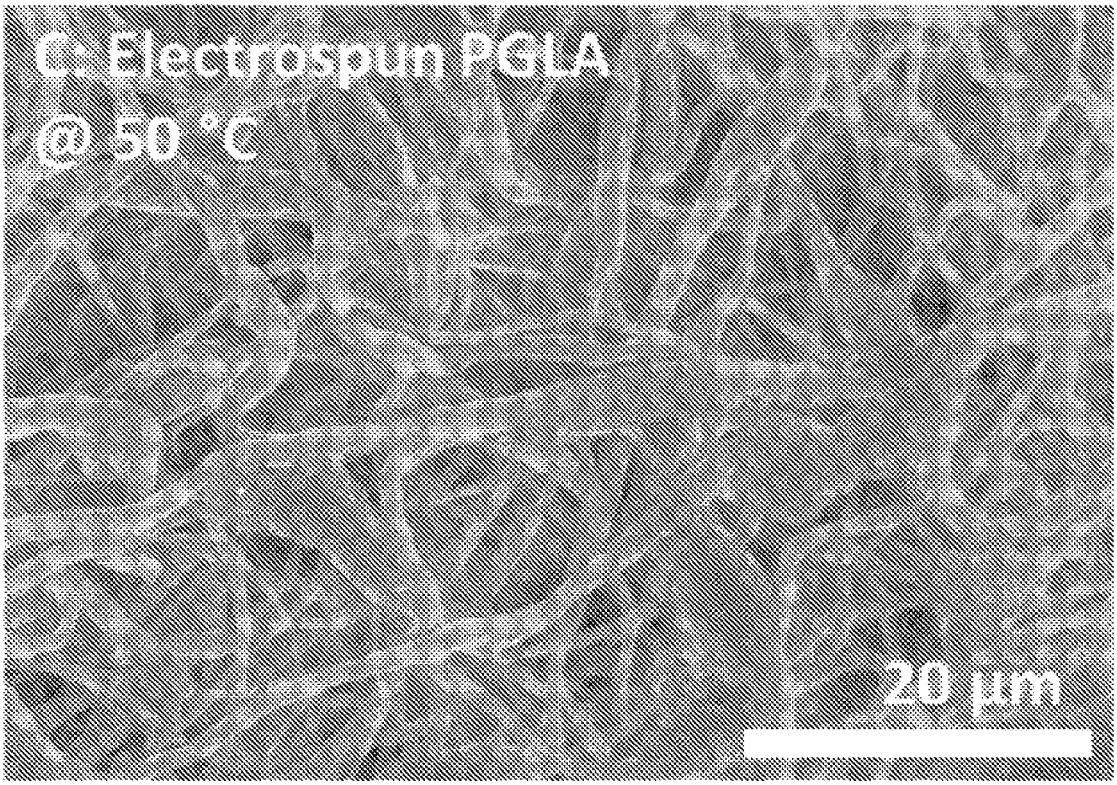
FIG. 6 shows an electron microscopy image of PGLA after being exposed to 50° C.
Figure 7:
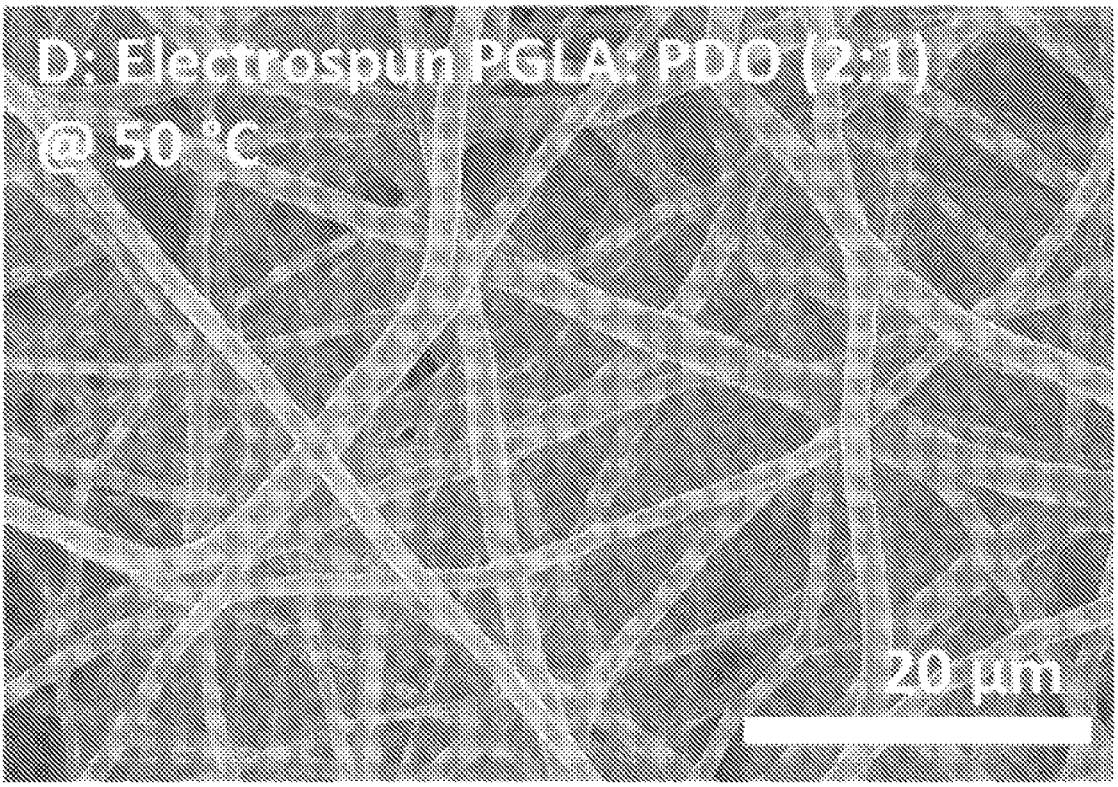
FIG. 7 shows an electron microscopy image of a PGLA/PPD composite with a 2:1 ratio after being exposed to 50° C.

FIG. 3 shows 90/10 PGLA and PPD cospun fibers of the current disclosure after exposure to 45° C. for 30 minutes. As FIG. 3 illustrates, the fibers retain their mechanical and physical properties and do not exhibit the deformities, clumping or gathering exhibited by the 90/10 PGLA fibers. PGLA fiber meshes were formed by making an 8 wt % PGLA (90:10) in HFIP and dissolving overnight at 50° C. Electrospun meshes were formed by depositing the solution through a 20 gauge needle array (comprised of four needles spaced 0.57 inches apart) at a flow rate of 5 ml/hr at a voltage of 22 kV. Co-spun meshes were prepared by dissolving the aforementioned PGLA and a second solution of 9 wt % PPD in HFIP and dissolving overnight at 50° C. The co-spun mesh was then produced by dispensing the different solutions through an alternating needle sequence within the needle array (two 20 gauge needles and two 25 gauge needles spaced 0.57 inches apart) to generate an intermixed population of PPD and PGLA fibers. The flow rates of the PPD and PGLA can be adjusted to generate a majority of one or the other. In this example, PPD was metered at a flow rate of 2.5 ml/hr and PGLA was metered at 5 ml/hr to generate an electrospun mesh comprised of two parts PGLA (~66%) and one part PPD (~33%).

In some embodiments, the mesh or web of the present disclosure may further comprise one or more bioactive or therapeutic agents, as well as methods of delivering therapeutic agents. The method comprises the step of applying a mesh or web at a treatment site wherein the polymers of the mesh or web comprise at least one base polymer and one or more bioactive and/or therapeutic agents. Biocompatible polymeric compositions containing a therapeutic agent can be prepared by the cold-worked or hot-worked method, depending on the heat-resistance of the therapeutic agent. For therapeutic agents that are likely to be inactivated by heat, the cold-worked method is preferred. Briefly, the polymer components of the mesh or web, either the major component, the minor component or both, may be completely melted in the absence of the therapeutic agent. The melted composition is cooled to room temperature or below to delay crystallization of the polymer in the composition. In certain embodiments, the cooling is conducted at a rate of about 10° C. per minute. The therapeutic agent is then added to the melted composition at room temperature or below and mixed thoroughly with the composition to create a homogeneous blend.

In an alternative embodiment, the mesh or web of the current disclosure may have the bioactive and/or therapeutic agents applied to one or more specific sections of the mesh or web, as opposed to the entire construct. Within certain embodiments, the mesh or web can be either dip-coated or spray-coated with one or more bioactive agents, or with a composition which releases one or more bioactive agents over a desired time frame. In yet other embodiments, the fibers themselves may be constructed to release the bioactive agent(s) (see e.g., U.S. Pat. No. 8,128,954 which is incorporated by reference in its entirety).

The therapeutic agents may include fibrosis-inducing agents, antifungal agents, antibacterial agents, anti-inflammatory agents, anti-adhesion agents, osteogenesis and calcification promoting agents, antibacterial agents and antibiotics, immunosuppressive agents, immunostimulatory agents, antiseptics, anesthetics, antioxidants, cell/tissue growth promoting factors, lipopolysaccharide complexing agents, peroxides, anti-scarring agents, anti-neoplastic, anti-cancer agents and agents that support ECM integration.

Examples of fibrosis-inducing agents include, but are not limited to talcum powder, metallic beryllium and oxides thereof, copper, silk, silica, crystalline silicates, talc, quartz dust, and ethanol; a component of extracellular matrix selected from fibronectin, collagen, fibrin, or fibrinogen; a polymer selected from the group consisting of polylysine, poly(ethylene-co-vinylacetate), chitosan, N-carboxybutyl-chitosan, and RGD proteins or peptide sequences greater than one amino acid in length; vinyl chloride or a polymer of vinyl chloride; an adhesive selected from the group consisting of cyanoacrylates and crosslinked poly(ethylene glycol)-methylated collagen; an inflammatory cytokine (e.g., TGF.beta., PDGF, VEGF, bFGF, TNF.alpha., NGF, GM-CSF, IGF-a, IL-1, IL-1-.beta., IL-8, IL-6, and growth hormone); connective tissue growth factor (CTGF); a bone morphogenic protein (BMP) (e.g., BMP-2, BMP-3, BMP-4, BMP-5, BMP-6, or BMP-7); leptin, and bleomycin or an analogue or derivative thereof. Optionally, the device may additionally comprise a proliferative agent that stimulates cellular proliferation. Examples of proliferative agents include: dexamethasone, isotretinoin (13-cis retinoic acid), 17-e-estradiol, estradiol, 1-a-25 dihydroxyvitamin Ds, diethylstibesterol, cyclosporine A, L-NAME, all-trans retinoic acid (ATRA), and analogues and derivatives thereof. (see US Pat. Pub. No. 2006/0240063, which is incorporated by reference in its entirety).

Examples of antifungal agents include, but are not limited to polyene antifungals, azole antifungal drugs, and Echinocandins.

Examples of antibacterial agents and antibiotics include, but are not limited to erythromycin, penicillins, cephalosporins, doxycycline, gentamicin, vancomycin, tobramycin, clindamycin, and mitomycin.

Examples of anti-inflammatory agents include, but are not limited to non-steroidal anti-inflammatory drugs such as ketorolac, naproxen, diclofenac sodium and flurbiprofen.

Examples of anti-adhesion agents include, but are not limited to talcum powder, metallic beryllium and oxides thereof, copper, silk, silica, crystalline silicates, talc, quartz dust, and ethanol.

Examples of osteogenesis or calcification promoting agents include, but are not limited to bone fillers such as hydroxyapatite, tricalcium phosphate, calcium chloride, calcium carbonate, and calcium sulfate, bioactive glasses, bone morphogenic proteins (BMPs), such as BMP-2, BMP-3, BMP-4, BMP-5, BMP-6, and BMP-7.

Examples of immunosuppressive agents include, but are not limited to glucocorticoids, alkylating agents, antimetabolites, and drugs acting on immunophilins such as ciclosporin and tacrolimus.

Examples of immunostimulatory agents include, but are not limited to interleukins, interferon, cytokines, toll-like receptor (TLR) agonists, cytokine receptor agonist, CD40 agonist, Fc receptor agonist, CpG-containing immunostimulatory nucleic acid, complement receptor agonist, or an adjuvant.

Examples of antiseptics include, but are not limited to chlorhexidine and tibezonium iodide.

Examples of antioxidants include, but are not limited to antioxidant vitamins, carotenoids, and flavonoids.

Examples of anesthetic include, but are not limited to lidocaine, mepivacaine, pyrrocaine, bupivacaine, prilocalne, and etidocaine.

Examples of cell growth promoting factors include but are not limited to, epidermal growth factors, human platelet derived tgf-b, endothelial cell growth factors, thymocyte-activating factors, platelet derived growth factors, fibroblast growth factor, fibronectin or laminin.

Examples of lipopolysaccharide complexing agents include, but are not limited to polymyxin.

Examples of peroxides, include, but are not limited to benzoyl peroxide and hydrogen peroxide.

Examples of antineoplastic/anti-cancer agents include, but are not limited to paclitaxel, carboplatin, miconazole, leflunamide, and ciprofloxacin.

Examples of anti-scarring agents include, but are not limited to cell-cycle inhibitors such as a taxane, immunomodulatory agents such as serolimus or biolimus (see, e.g., paras. 64 to 363, as well as all of us U.S. Pat. Pub. No. 2005/0149158, which is incorporated herein by reference in its entirety).

Examples of agents that support ECM integration include, but are not limited to gentamicin.

It is recognized that in certain forms of therapy, combinations of agents/drugs in the same polymeric composition can be useful in order to obtain an optimal effect. Thus, for example, an antibacterial and an anti-inflammatory agent may be combined in a single copolymer to provide combined effectiveness.

In one further embodiment, synthetic absorbable polymers may be formed into medical implants and/or scaffolds for tissue engineering and drug delivery devices. For instance, electrospinning may be employed to produce micro-fibrous materials with a topography similar to the native extracellular matrix. In a further embodiment, fiber formation through electrospinning may occur on the order of milliseconds. This may inhibit polymer crystallization and may yield an unstable material that may undergo morphological and mechanical property changes when exposed to heat.

In a further embodiment, a thermally stabilized poly (glycolide-co-lactide) (PGLA) may be produced. In some further embodiments, the PGLA ratio may be 99:1, 95:5, 90:10, 85:15, 80:20, 75:25, 70:30, 65:35, 60:40, 55:45, 50:50 or variations between these ratios such as 93:7, 87:13, 78:22, etc.

In a still further embodiment, a method of producing an implant or scaffold is disclosed. PGLA and poly(paradioxanone) (PPD), procured from Purac and Evonic, respectively, may be prepared by separately dissolving the PGLA and PPD in Hexafluoroisopropanol (HFIP), obtained from Dupont, and electrospinning the resulting solutions on an electrospinning apparatus using a field of 1.74 kV/cm. Polymer solutions were prepared by weighing out 0.8 g PGLA and 0.9 g PPD, dissolving both in 10 mL of HFIP overnight with moderate shaking (75 rpm) at 50° C. After overnight incubation (>12 hrs) solutions were allowed to cool to room temperature, e.g., 22±3° C. for 1 hour prior to loading into syringes. Solutions were loaded into 12 ml syringes dispensed out of adjacent, yet separate, 20 gauge needles arranged with a needle spacing of about 0.5 inches. In order to generate varying fabric compositions, the flow rate and the number of needles per solution type (PPD vs PGLA) were modulated to generate fabrics with varying compositions and properties.

In one comparative example, PGLA and PPD solutions were deposited from an array of separate 20 gauge needles at varying flow rates between 1 and 12 mL/hour. Composite materials were generated with the following PGLA:PPD ratios 2:0, 2:1, 1:1, 1:2, and 0:2. These ratios can be generated by multiple methods, or a combination of methods, which include varying: (1) the relative number of needles, (2) individual needle flow rates, and (3) solution concentrations. In this particular example, solution concentrations remained constant and the number of needles was varied to generate the various compositions. The resulting fabric contained well-defined and relatively uniform small-diameter fibers deposited in a randomly oriented fibrous mat. Differences between PGLA and PPD fibers were not obvious based on SEM and light microscopy, but the presence of fibers without significant size and deformation indicate that fibers formed from the individual solutions and contain only one material, as opposed to very large fibers or inconsistent/film-like morphology which could be associated with solution blending. These electrospun samples were assessed for morphology, tensile mechanics, free shrinkage, and crystallization. Tables A-D, see FIGS. 13, 15, 17 and 18, illustrate the characteristics of the resulting fibers and the data sets, see FIGS. 14, 16, 19, and 20, identify the samples used to provide the data illustrated in the respective Tables. The data marked by the * symbol shows significant deviation in properties from the PGLA control group.

Figure 8:
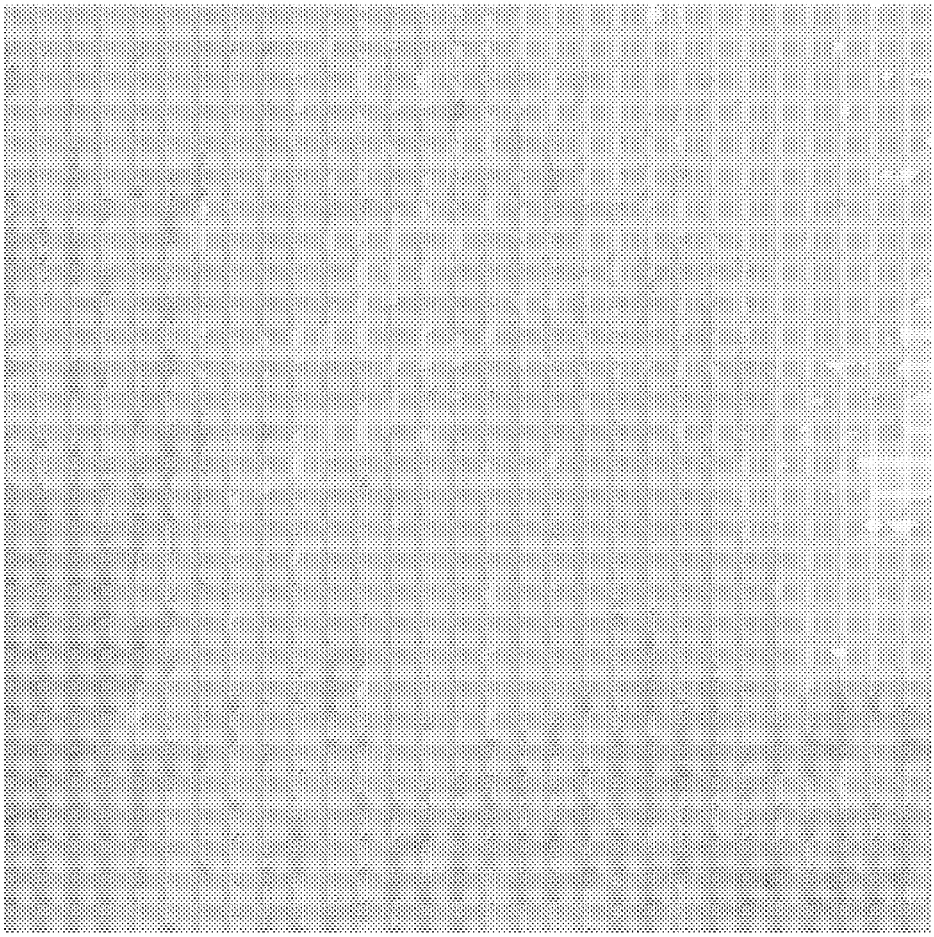
FIG. 8 demonstrates an electrospun construct of the present disclosure made at room temperature.
Figure 9:
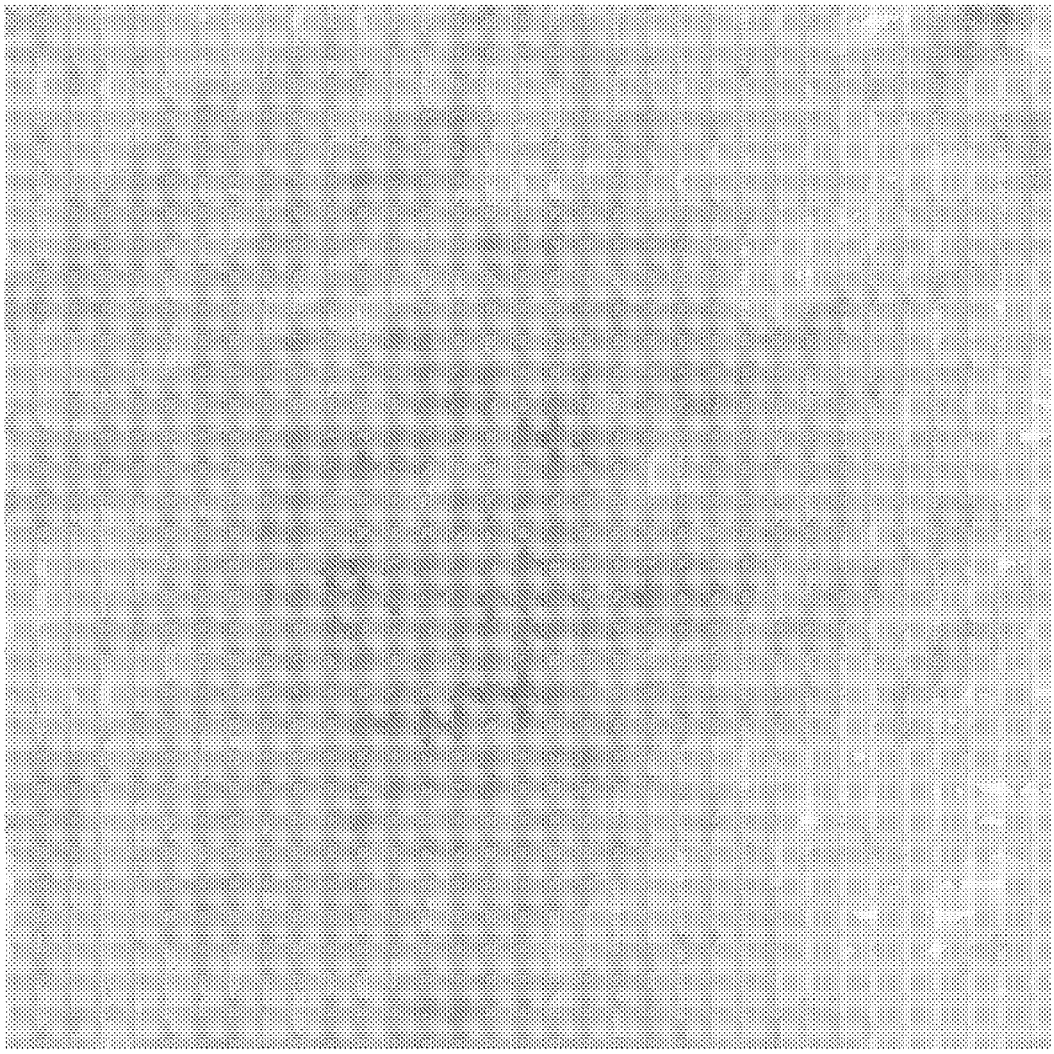
FIG. 9 demonstrates an electrospun construct of the present disclosure formed at −80° C.

As the above data illustrate, electrospun materials were fabricated from PGLA, PPD and composites containing both. All samples exhibited fibrous morphology with sub-micron fiber diameters (<1 μm). FIGS. 4-7 illustrate the fibrous morphology as well as the impact of exposure to 50° C. conditions to same. As the data shows, inclusion of increasing PPD amounts results in thermally stable fabric, such as that shown in FIG. 7. Comparatively, neat PGLA displayed contraction in pore size and disordered fiber morphology resultant of crystallization within the fiber, see FIG. 6. Incorporation of PPD into PGLA at all loading levels, led to maintenance of both fiber morphology and pore size, see FIG. 7. Free shrinkage of electrospun PGLA without PPD, see FIG. 6, possessed an average contraction of 22±8% while inclusion of PPD at 33% loading content significantly lowered this to 6±3%, see FIG. 7. At PPD levels of >50%, free shrinkage decreased to less than 2%. FIGS. 8 and 9 demonstrate the bulk differences in electrospun constructs of the present disclosure made at room temperature, FIG. 8, and at −80° C., FIG. 9. It is apparent that the construct made at room temperature is relatively smooth, whereas the construct made at −80° C. has a fluffy, porous texture. The FIG. 8 construct may be used as a barrier membrane and may exhibit limited cell ingress, increased strength, lower pore size, and lower porosity. Meanwhile, the FIG. 9 construct may exhibit increased pore size, increased porosity, may allow for better cellular ingress and cellular attachment, as well as may allow for better extracellular matrix production/accumulation and may exhibit lower overall strength.

Figure 10:
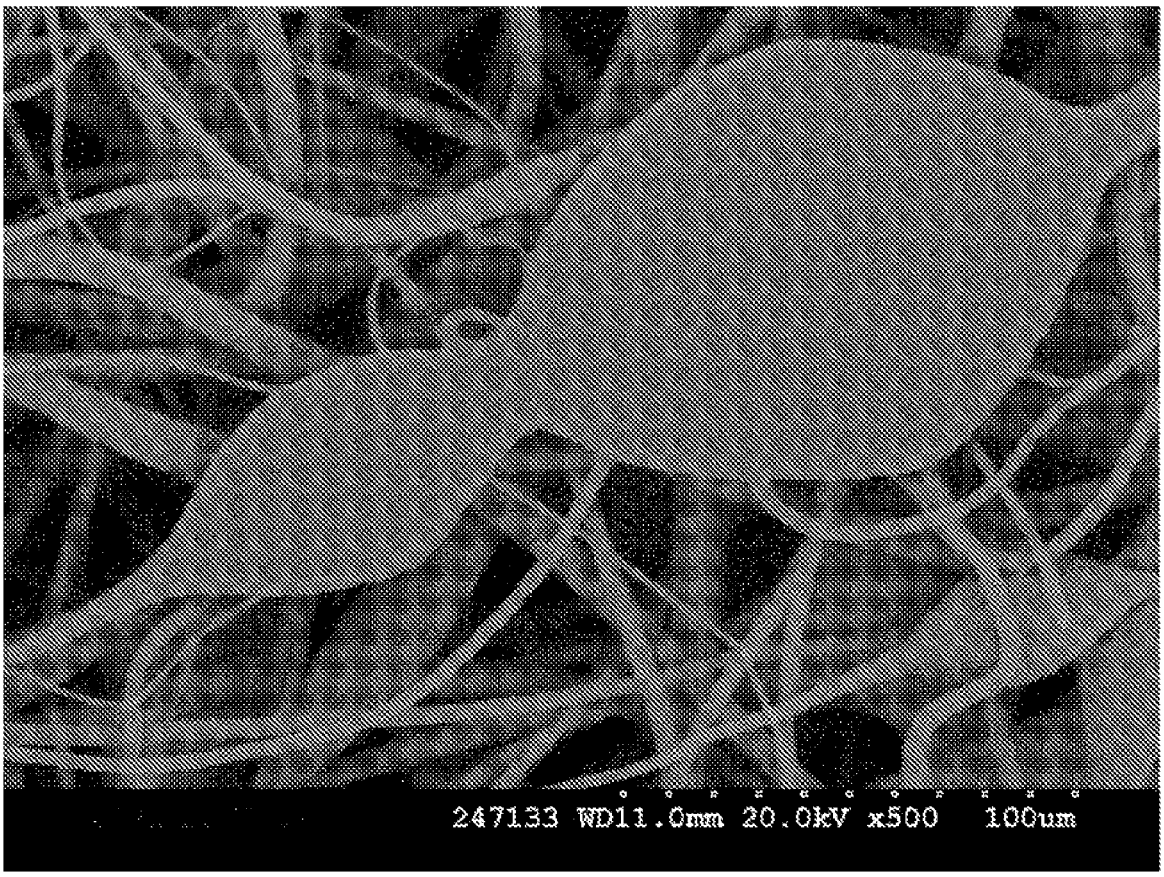
FIG. 10 shows an electron microscopy image of a poorly formed electrospun fabric.
Figure 11:
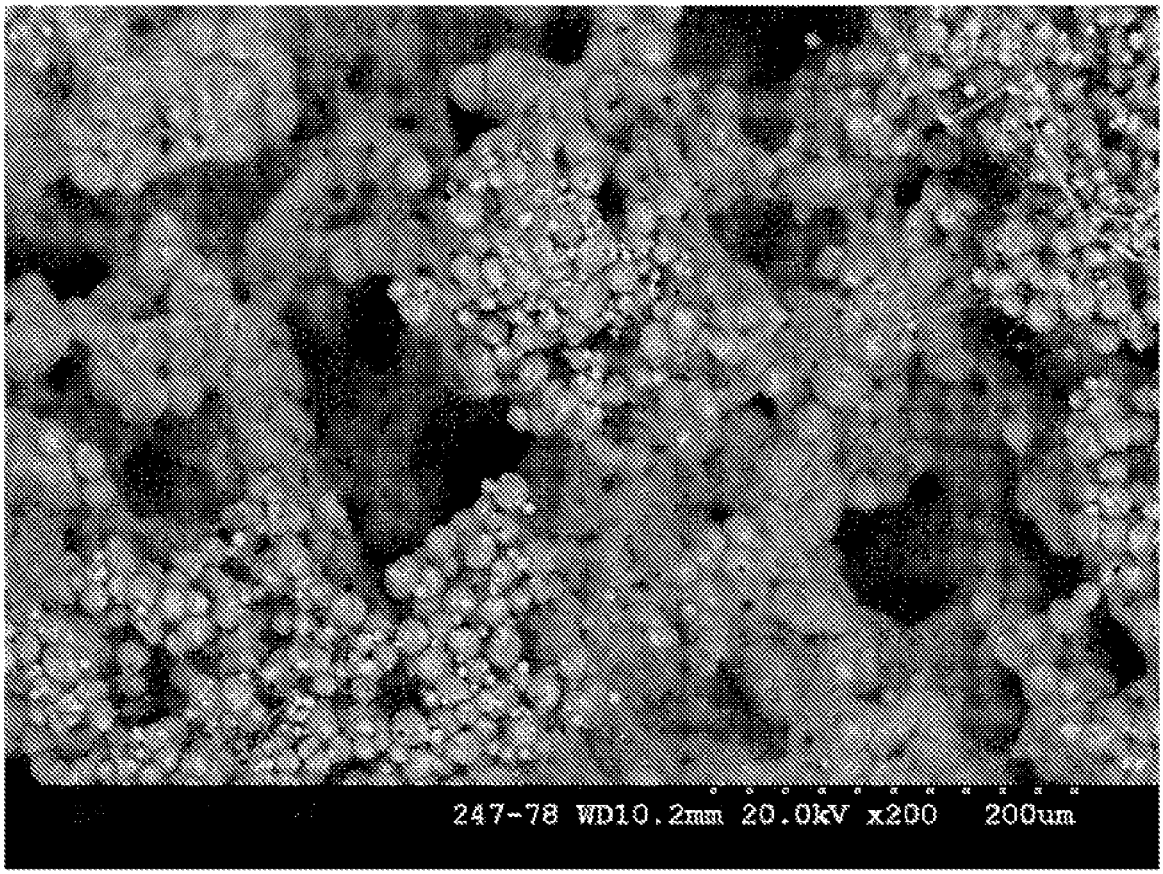
FIG. 11 shows a further electron microscopy image of a poorly formed electrospun fabric.
Figure 12:
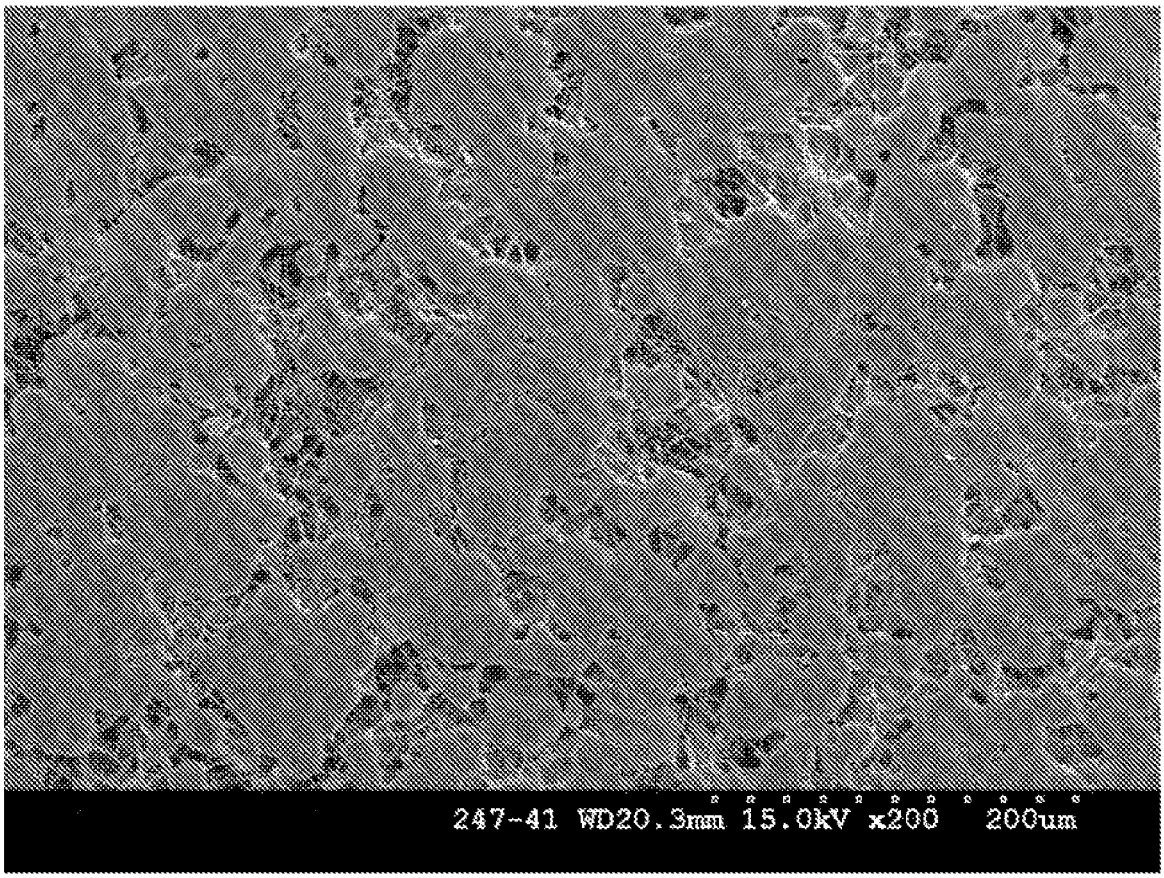
FIG. 12 shows yet another electron microscopy image of a poorly formed electrospun fabric.
Figure 13:
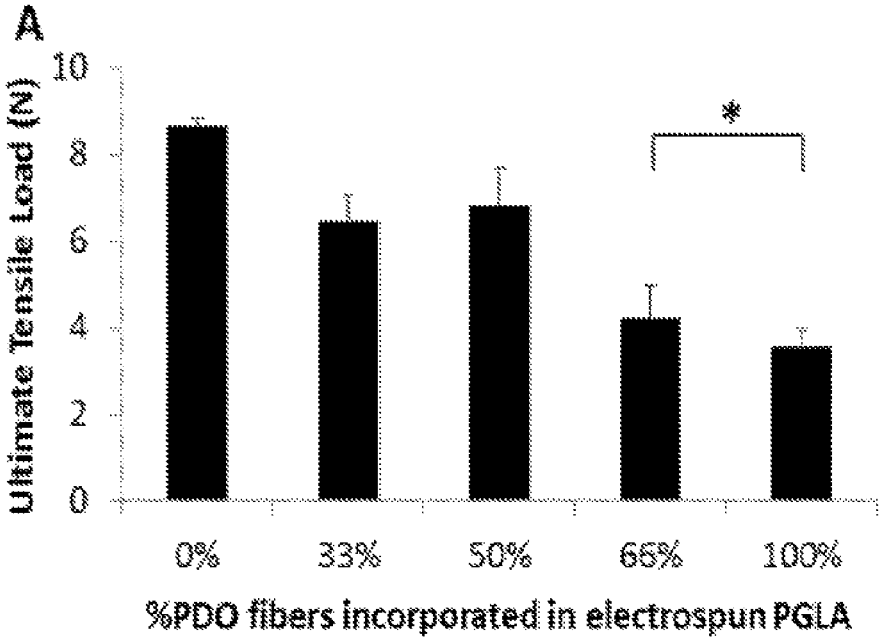
FIG. 13 shows Table A and its associated data.
Figure 15:
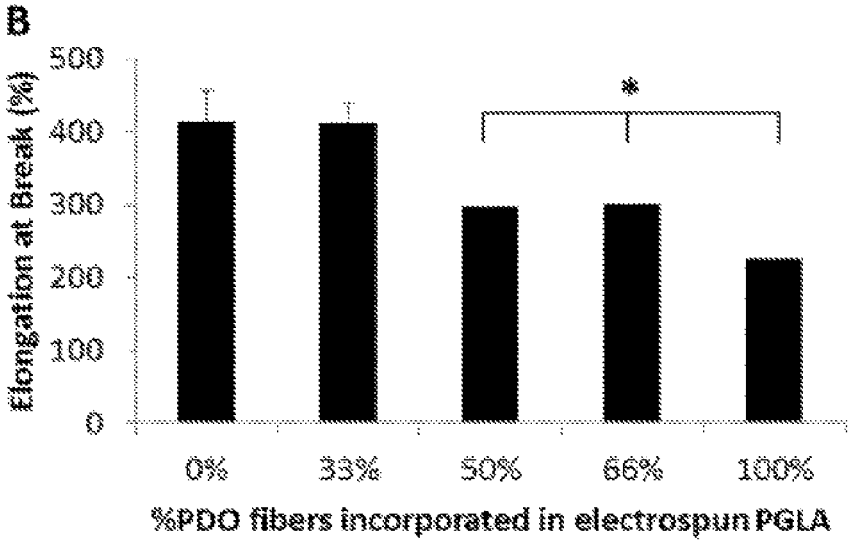
FIG. 15 is Table B and its associated data.

FIGS. 10-12 demonstrate the importance of the conditions contain in the present disclosure. FIGS. 10-12 illustrate electron microscopy images of poorly formed electrospun products. FIG. 10 shows beads or "swellings" throughout the structure of the fabric. FIG. 11, meanwhile illustrates an improperly formed electrospun fabric that appears "granular" in construction as the polymers in the fibers have formed beads instead of polymer fibers. FIG. 12 illustrates a resulting electrospun fabric when too much solvent is used in the formation process and "plates" or solid regions form within the structure of the electrospun fabric.

In a further embodiment, PGLA was dissolved in HFIP at 4.8% and PPD was dissolved in HFIP at 5.3%. Electrospinning was conducted by dispensing the different solutions through an alternating needle sequence within the needle array (separated by 0.57" each) to generate an intermingled population of PGLA and PPD fibers. The flowrate of PGLA solution was 5 mL/hr/needle and the flowrate of PPD solution was 2.5 mL/hr/needle. The electrospun fabric was created with equal needles of PGLA and PET solutions, creating a fabric that, by weight, contained 33% PPD and 67% PGLA, as well as by varying the relative number of each needle type to change the final composition.

Mechanical analysis indicated that incorporation of PPD decreased the ultimate tensile load and elongation at high content levels, such as >50% while suture pull-out was lowered at all loading levels with PPD>33%. In a preferred embodiment, PPD of 33% exhibits the optimal mechanical properties while minimizing thermal shrinkage. DSC analysis indicated that thermally treated samples had a reduction in crystallization peak, not shown.

Figure 21:
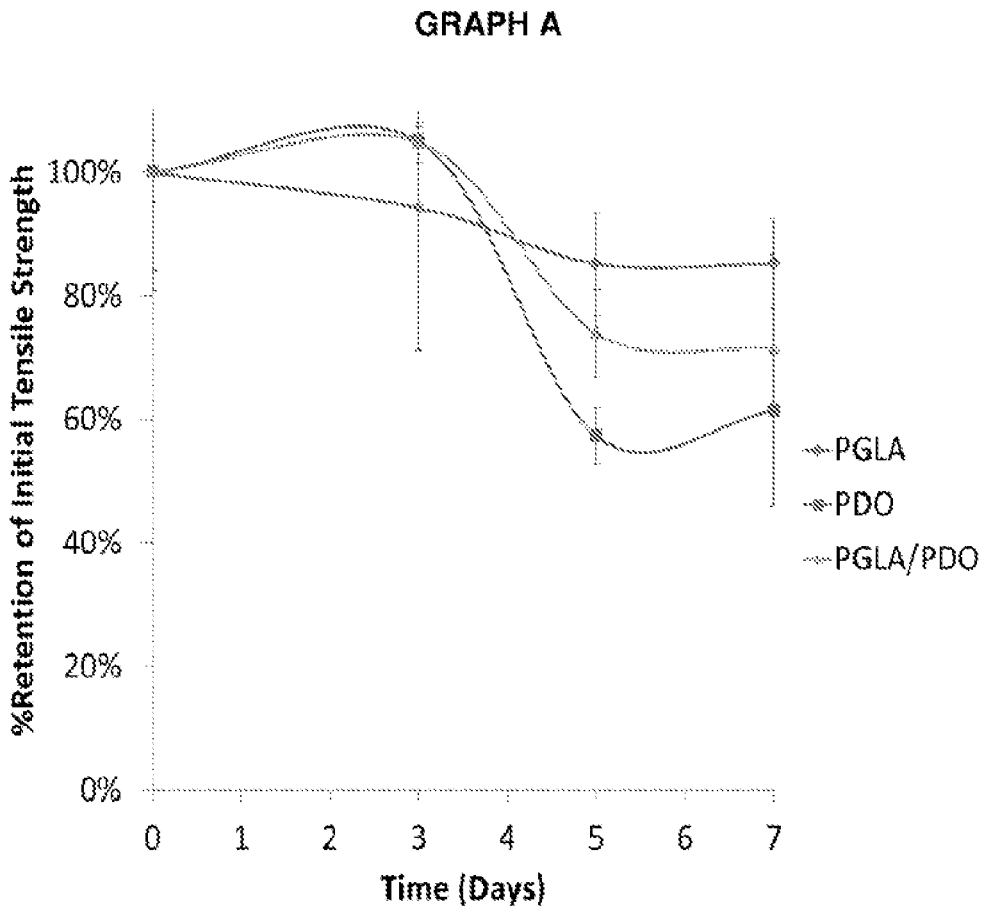
FIG. 21 is Graph A and its associated data.
Figure 22:
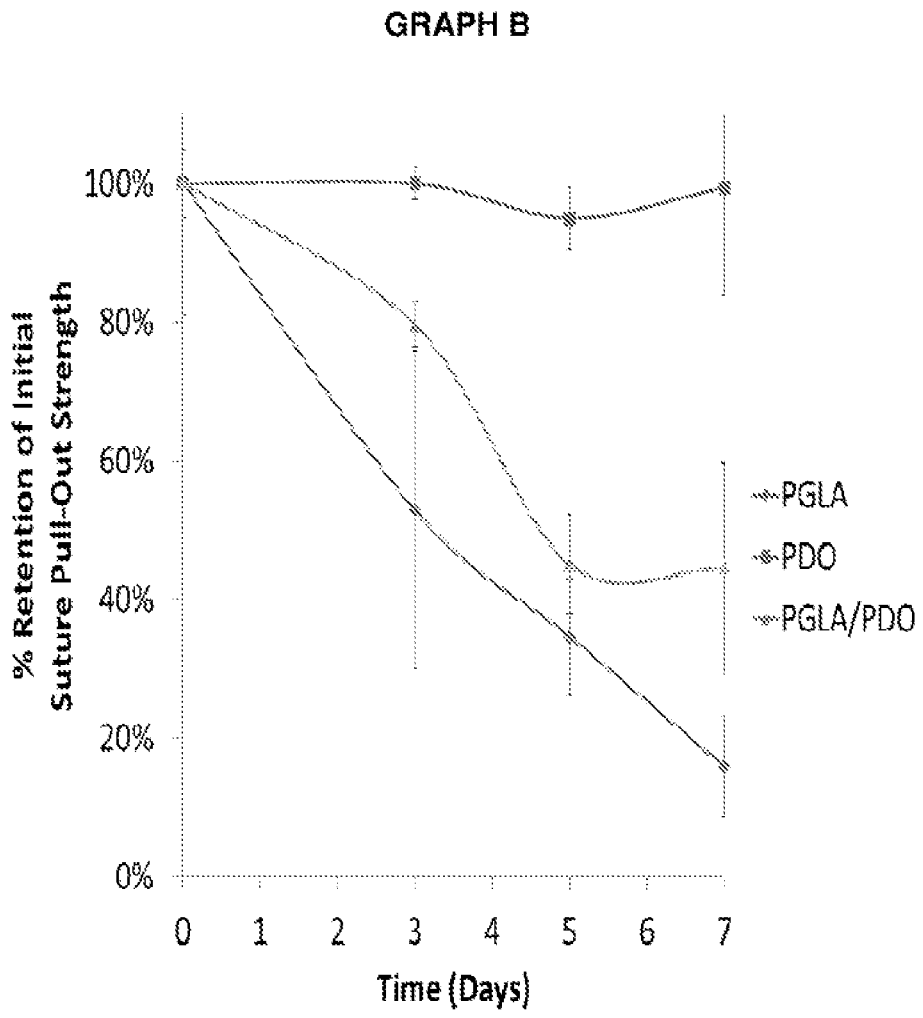
FIG. 22 is Graph B and its associated data.
Figure 23:
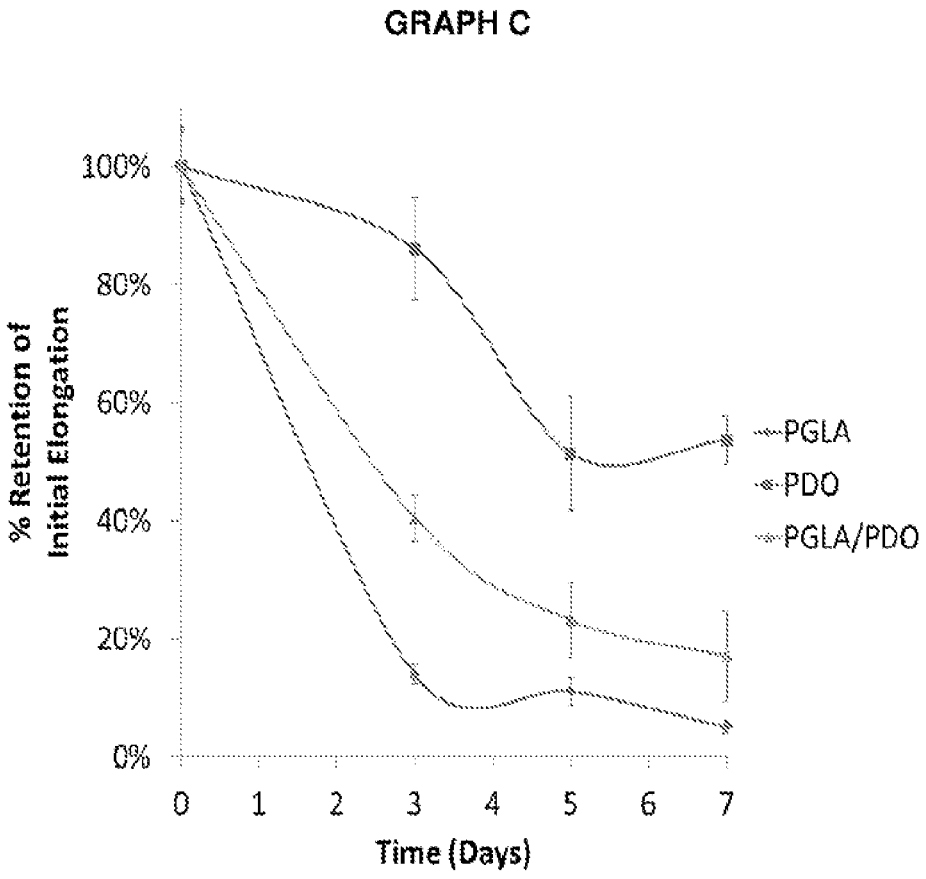
FIG. 23 is Graph C and its associated data.

Graphs A, B and C, see FIGS. 21-23, show the results of mechanical testing over seven days under in vitro conditions. As Graph A shows, PGLA maintained tensile strength over seven days in vitro, but lost suture pull-out strength and elongation at break, see Graphs B and C. Reduction in elongation may be attributed to the thermally sensitive and amorphous nature of the material. PPD, meanwhile, exhibited loss of tensile strength, see Graph A, but maintained suture pull-out strength, see Graph B, and a slight reduction in elongation at break, see Graph C. The composite PGLA: PPD system exhibited intermediate properties between PGLA and PPD expressing hybrid properties between both systems.

Graph A, see FIG. 21, shows percent retention of initial tensile strength over seven days in vitro. PGLA maintained tensile strength while PPD and the composite system demonstrated a reduction in tensile strength.

Graph B, see FIG. 22, shows initial suture pull-out strength over seven days in vitro. PPD maintained suture pull-out strength throughout the seven day period while PGLA and the composite system demonstrated reduction in pull out strength.

Graph C, see FIG. 23, shows percent retention of initial elongation over seven days in vitro. PGLA demonstrated significant reduction in elongation which may be due to molecular reorganization in electrospun fibers, resulting in brittle material.

In one embodiment, the electrospun fabrics may have a three-dimensional structure. In a further embodiment, the fiber populations may be dispersed throughout the three dimensional structure such that the relative ratios of the fibers to one another remains substantially constant throughout the structure of the fabric. In other embodiments, the structure of the fabric may be modified such that the ratios of the fabrics to one another vary throughout the structure, such as one fiber being predominately present on the exteriors of the three dimensional structure but less present, or lacking altogether, in the interior of the structure.

Figure 17:
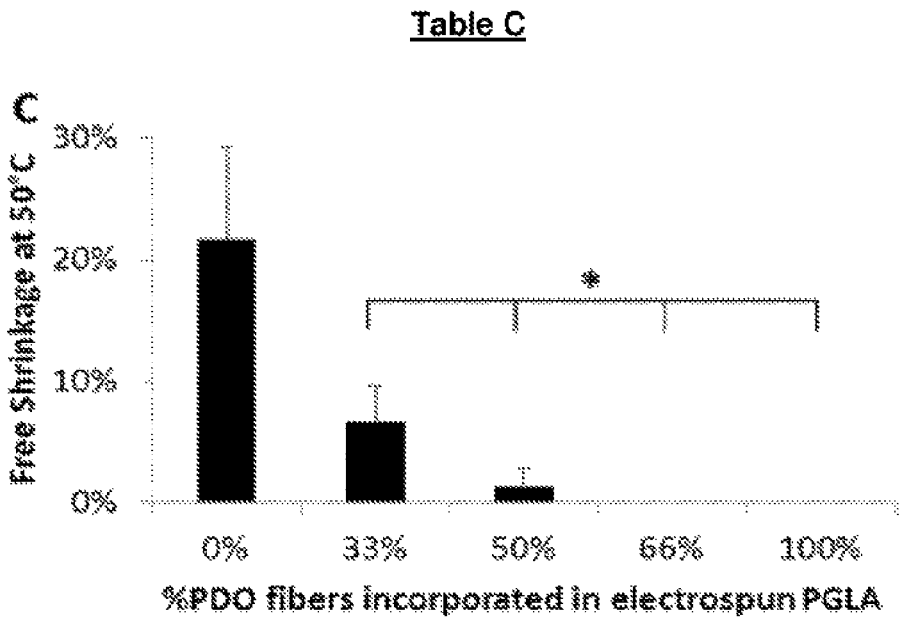
FIG. 17 is Table C and its associated data.
Figure 18:
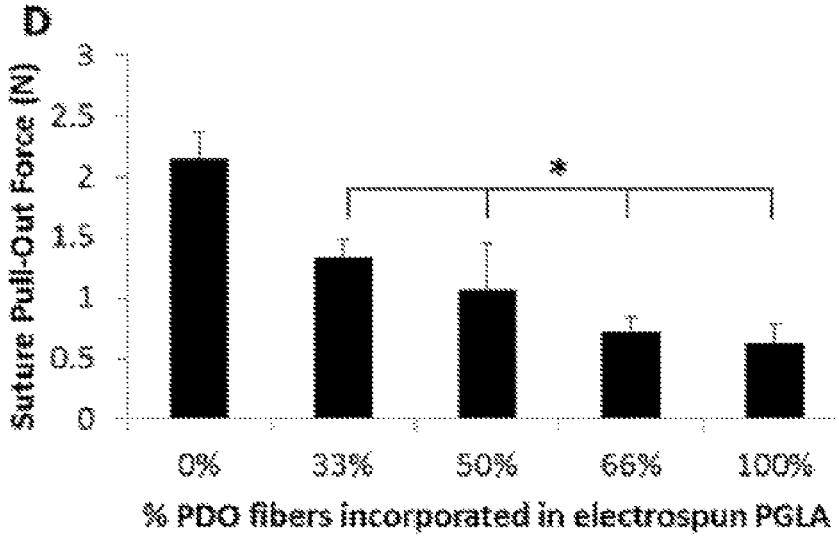
FIG. 18 is Table D and its associated data.

As the data shows, PPD may serve to stabilize the dimensions of electrospun fabrics upon exposure to heat while maintaining mechanical properties. In those examples where PPD was not present, the electrospun fabric undergoes changes in physical properties in the presence of heat, such as significantly marked shrinking. For example Table C, see FIG. 17, shows the percent free shrinkage is greater than 20% when the electrospun PGLA fabric contains no PPD. The ultimate tensile load, elongation at break, and suture pull-out force as shown by Tables A, B, and D also demonstrate the effects of PPD incorporated into electrospun PGLA. However, use of varying fiber populations may produce robust, thermally stable electrospun materials and may influence long term mechanical performance providing temporal properties with respect to mechanics, resorption, and biological response.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A thermally stable nonwoven barrier comprising:

two independent fiber populations;

a major thermally unstable fiber population comprising polymers or copolymers that are degradable by hydrolysis or other biodegradation mechanisms and are derived from cyclic monomers selected from glycolide, lactide, caprolactone, para-dioxanone, trimethylene carbonate or mixtures thereof;

a minor thermally stable fiber population that is absorbable or nonabsorbable, and comprises polymers or copolymers selected from polyesters, a block copolymer having one or more blocks of polydioxanone, homo polymer of poly(E-caprolactone), a block copolymer having one or more blocks of caprolactone, or poly(lactic acid);

wherein the minor thermally stable fiber population comprises 13 wt % to up to 49 wt % of the thermally stable nonwoven barrier;

wherein the major thermally unstable fiber population and the minor thermally stable fiber population of said barrier are co-mingled in a fibrous web;

wherein each fiber population is not a composite fiber wherein the individual fiber comprises nonstable and stabilizing elements; and wherein said barrier does not decrease in size more than 10% at temperatures of 30° C. to 50° C.

2. The barrier of claim 1, wherein the major thermally unstable fiber population is absorbable and the minor thermally stable fiber population is absorbable.

3. The barrier of claim 1, wherein the minor thermally stable fiber population has a higher crystallization temperature than the major thermally unstable fiber population.

4. The barrier of claim 3, wherein the major thermally unstable fiber population has a crystallization temperature in the range of 50 to 80° C. and the minor thermally stable fiber population has a crystallization temperature in the range of 100 to 140° C.

5. The barrier of claim 1, wherein porosity is 75% or greater.

6. The barrier of claim 1, wherein the minor thermally stable fiber population has a lower crystallization temperature than the major thermally unstable fiber population.

7. The barrier of claim 1, wherein porosity of the thermally stable nonwoven barrier increases as the major thermally unstable fiber population is absorbed.

8. The barrier of claim 1, wherein the major thermally unstable fiber population is a bioabsorbable copolymer derived from cyclic monomers selected from the group consisting of glycolide, lactide, caprolactone, paradioxanone, trimethylene carbonate, or mixtures thereof, or is an absorbable copolymer of glycolide and lactide, is an absorbable PGLA copolymer with a monomer ratio of glycolide to lactide of about 90:10, poly(glycolic acid), polyglycolide, poly(glycolide-co-lactide), poly(glycolide-co-caprolactone), and polycaprolactone (PCL) or combinations thereof.

9. The barrier of claim 1, wherein the minor thermally stable fiber population is absorbable, and is a polyetherester, a block copolymer having one or more blocks of polydioxanone wherein polydioxanone comprises from 10% to 80% of the copolymer, polylactide, polydioxanone, polycaprolactone, poly(lactide-co-caprolactone-co-trimethylene carbonate), or polylactide copolymers.

10. The barrier of claim 1, further comprising one or more bioactive or therapeutic agents.

11. The barrier of claim 1, wherein the barrier is made by a process comprising spun melt, spun bond, melt blowing, solution spinning, wet spinning, centrifugal melt spinning, liquid shear spinning, or electrospinning.

* * * * *